US008165493B2

(12) United States Patent
Chadani et al.

(10) Patent No.: US 8,165,493 B2
(45) Date of Patent: Apr. 24, 2012

(54) PROCESS CARTRIDGE AND ELECTROPHOTOGRAPHIC IMAGE FORMING APPARATUS

(75) Inventors: Kazuo Chadani, Suntou-gun (JP); Hiroyuki Munetsugu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 12/471,899

(22) Filed: May 26, 2009

(65) Prior Publication Data

US 2009/0297214 A1 Dec. 3, 2009

(30) Foreign Application Priority Data

May 27, 2008 (JP) ..... 2008-138038

(51) Int. Cl.
*G03G 21/18* (2006.01)

(52) U.S. Cl. ..... 399/111; 399/113

(58) Field of Classification Search ..... 399/111, 399/113

See application file for complete search history.

(56) References Cited

U.S. PATENT DOCUMENTS

| | | | | |
|---|---|---|---|---|
| 5,943,529 | A | 8/1999 | Miyabe et al. | 399/111 |
| 5,966,567 | A | 10/1999 | Matsuzaki et al. | 399/111 |
| 6,144,815 | A | 11/2000 | Chadani et al. | 399/27 |
| 6,173,140 | B1 | 1/2001 | Suzuki et al. | 399/113 |
| 6,173,145 | B1 | 1/2001 | Chadani et al. | 399/265 |
| 6,178,302 | B1 | 1/2001 | Nagashima et al. | 399/106 |
| 6,205,305 | B1 | 3/2001 | Suzuki et al. | 399/106 |
| 6,219,504 | B1 | 4/2001 | Matsuzaki et al. | 399/92 |
| 6,282,389 | B1 | 8/2001 | Matsuzaki et al. | 399/111 |
| 6,301,457 | B1 | 10/2001 | Chadani et al. | 399/167 |
| 6,473,585 | B2 | 10/2002 | Abe et al. | 399/254 |
| 6,512,903 | B2 | 1/2003 | Chadani | 399/106 |
| 6,535,699 | B1 | 3/2003 | Abe et al. | 399/27 |
| 6,671,474 | B2 | 12/2003 | Chadani | 399/106 |
| 6,795,666 | B2 | 9/2004 | Miyabe et al. | 399/109 |
| 6,823,155 | B2 | 11/2004 | Tsuda et al. | 399/111 |
| 6,931,226 | B2 | 8/2005 | Chadani et al. | 399/109 |
| 6,934,485 | B2 | 8/2005 | Miyabe et al. | 399/90 |
| 6,980,759 | B2 | 12/2005 | Kanno et al. | 399/111 |
| 7,136,604 | B2 | 11/2006 | Chadani et al. | 399/90 |
| 7,174,117 | B2 * | 2/2007 | Okabe | 399/111 |

(Continued)

FOREIGN PATENT DOCUMENTS

| | | |
|---|---|---|
| JP | 5-281254 | 10/1993 |

(Continued)

OTHER PUBLICATIONS

Office Action in Japanese Patent Application No. 2008-138038, dated Jul. 5, 2011 (with excerpt English translation).

*Primary Examiner* — Sophia S Chen
(74) *Attorney, Agent, or Firm* — Fitzpatrick, Cella, Harper & Scinto

(57) ABSTRACT

A process cartridge that is detachably mountable to a main assembly of an electrophotographic image forming apparatus includes a drum unit supporting an electrophotographic photosensitive member and a developing unit supporting a developing roller. The developing unit is movable relative to the drum unit between a contacting position in which the developing roller is contacted to the electrophotographic photosensitive member and a spaced position in which the developing roller is spaced from the electrophotographic photosensitive member. The process cartridge further includes a positioning portion and a space maintaining member, with the space maintaining member retracting from the positioning portion to move the developing unit from the spaced position to the contacting position.

8 Claims, 20 Drawing Sheets

U.S. PATENT DOCUMENTS

| | | | | |
|---|---|---|---|---|
| 7,184,682 | B2 | 2/2007 | Chadani et al. | 399/90 |
| 7,184,688 | B2 * | 2/2007 | Ishii | 399/113 |
| 7,433,622 | B2 | 10/2008 | Chadani et al. | 399/90 |
| 7,499,663 | B2 | 3/2009 | Sato et al. | 399/106 |
| 7,570,900 | B2 | 8/2009 | Chadani et al. | 399/111 |
| 2008/0138114 | A1 | 6/2008 | Chadani et al. | 399/167 |
| 2008/0138115 | A1 | 6/2008 | Chadani et al. | 399/167 |
| 2009/0074454 | A1 | 3/2009 | Sato et al. | 399/113 |

FOREIGN PATENT DOCUMENTS

| | | |
|---|---|---|
| JP | 2001-312196 | 11/2001 |
| JP | 2001-337511 | 12/2001 |
| JP | 2002-244533 | 8/2002 |
| JP | 2006-276190 | 10/2006 |

* cited by examiner (a)

(b)

(b)

PROCESS CARTRIDGE AND ELECTROPHOTOGRAPHIC IMAGE FORMING APPARATUS

FIELD OF THE INVENTION AND RELATED ART

The present invention relates to a process cartridge, and an electrophotographic image forming apparatus which uses a process cartridge.

Here, an electrophotographic image forming apparatus means an apparatus which forms an image on recording medium with the use of an electrophotographic image forming method. Examples of an electrophotographic image forming apparatus include an electrophotographic copying machine, an electrophotographic printer (for example, laser beam printer, LED printer, etc.), a facsimile apparatus, a wordprocessor, etc.

A process cartridge means a cartridge in which an electrophotographic photosensitive drum and one or more processing apparatuses, that is, a charging means, a developing means, and a cleaning means, are integrally disposed, and which is removably mountable in the main assembly of an electrophotographic image forming apparatus. More specifically, a process cartridge means a cartridge in which an electrophotographic photosensitive drum, a charging means, and a developing means or cleaning means, are integrally disposed, and which is removably mountable in the main assembly of an image forming apparatus. It also means a cartridge in which an electrophotographic photosensitive drum, and at least one among a charging means, a developing means, and a cleaning means, are integrally disposed, and which is removably mountable in the main assembly of an image forming apparatus. Further, it also means a cartridge in which an electrophotographic photosensitive drum and a developing means are integrally disposed, and which is removably mountable in the main assembly of an image forming apparatus.

In the field of an electrophotographic image forming apparatus which uses an electrophotographic image formation process, it has been common practice to employ a process cartridge system, which integrally disposes an electrophotographic photosensitive drum and one or more means for processing the electrophotographic photosensitive drum in a cartridge so that they can be removably mountable in the main assembly of an image forming apparatus. A process cartridge system enables a user to maintain in effect an electrophotographic image forming apparatus by himself or herself, that is, without relying on a service person. Thus, it can drastically improve an electrophotographic image forming apparatus in operational efficiency. Therefore, a process cartridge system is widely in used in the field of an electrophotographic image forming apparatus.

An electrophotographic image forming apparatus forms an electrostatic latent image on its photosensitive drum by projecting a beam of light emitted by a laser, an LED, an ordinary lamp, or the like, while modulating the beam of light with the information regarding an image to be formed.

There are electrophotographic color image forming apparatuses of the so-called inline type, which are structured so that multiple process cartridges can be disposed in tandem in their process cartridge placement chambers. One of the methods for developing a latent image on the electrophotographic photosensitive drum in a process cartridge employed by an electrophotographic color image forming apparatus of the inline type is a developing method which places the developing means (more specifically, a development roller) in the process cartridge in contact with the electrophotographic photosensitive drum (this developing method hereafter may be referred to simply as a contact developing method). A contact developing method requires that during an image forming operation, a preset amount of contact pressure is maintained between the development roller and photosensitive drum. Thus, an electrophotographic color image forming apparatus of the inline type is structured so that during an image forming operation, the development roller(s) therein is (are) kept pressed upon the corresponding photosensitive drum(s).

If an electrophotographic image forming apparatus which employs a contact developing method is left unused for a long time with its development roller(s) kept pressed upon the photosensitive drum(s), it sometimes occurs that the elastic layer of the development roller becomes permanently deformed. Thus, it sometimes occurs that when an electrophotographic image forming apparatus employing a contact developing method is used after being left unused for a substantial length of time, images which are nonuniform in density are formed. Further, the pattern of this nonuniformity is related to the circumference of the development roller.

One of the proposals for solving this problem is disclosed in Japanese Laid-open Patent Application 2001-337511 (p. 05-p. 06, FIG. 2). This application proposes a combination of a process cartridge and an image forming apparatus, which is provided with a mechanism structured to keep the photosensitive and development roller separated while the image forming apparatus is not used for image formation.

Another solution to this problem is proposed in the form of a process cartridge, by Japanese Laid-open Patent Application 2006-276190 (p. 09-p. 11, FIGS. 6-8). According to this patent application, a process cartridge is provided with a mechanism structured so that while the process cartridge is out of the main assembly of the image forming apparatus, its development roller is kept separated from its photosensitive drum, and also, so that as the process cartridge is mounted into the main assembly of the image forming apparatus, the development roller, which has been kept separated from the photosensitive drum, is automatically placed in contact with the photosensitive drum. In those days when the above-described technologies were invented, they were sufficient to satisfy users in terms of image forming apparatus performance. However, it has come to be desired by the users of image forming apparatuses of the abovementioned type to further improve in performance the image forming apparatuses of the aforementioned type.

SUMMARY OF THE INVENTION

The present invention is one of the further developments of the above-described conventional technologies. Thus, the primary object of the present invention is to provide a combination of a process cartridge and an electrophotographic image forming apparatus, which is simple in structure, and yet, places the development roller and photosensitive drum in the process cartridge in contact with each other, automatically as necessary, that is, without troubling a user.

Another object of the present invention is to provide a combination of a process cartridge and an electrophotographic image forming apparatus, which is significantly smaller in size than any of the conventional combinations of a process cartridge and an electrophotographic image forming apparatus.

According to an aspect of the present invention, there is provided a process cartridge detachably mountable to a main assembly of an electrophotographic image forming apparatus, said process cartridge comprising a drum unit supporting an electrophotographic photosensitive member and having a process cartridge positioning portion which is engageable with a main assembly positioning portion provided in the main assembly of the apparatus when said process cartridge is mounted to the main assembly of the apparatus; a developing unit supporting a developing roller for developing an electrostatic latent image formed on said electrophotographic photosensitive member with a developer, wherein said developing unit is movable relative to said drum unit between a contacting position in which said developing roller is contacted to said electrophotographic photosensitive member and a spaced position in which said developing roller is spaced from said electrophotographic photosensitive member; and a space maintaining member movable between an engaging position for maintaining said developing unit in the spaced position and a releasing position for permitting said developing unit to move to the contacting position, wherein said space maintaining member is moved to the releasing position by being abutted by the main assembly positioning portion when said process cartridge is mounted to the main assembly of the apparatus.

According to another aspect of the present invention, there is provided an electrophotographic image forming apparatus for forming an image on a recording material, said apparatus comprising (i) a main assembly positioning portion; (ii) a process cartridge detachably mounted to the main assembly of the electrophotographic image forming apparatus, said process cartridge including, a drum unit supporting an electrophotographic photosensitive member and having a process cartridge positioning portion which is engageable with the main assembly positioning portion when said process cartridge is mounted to the main assembly of the apparatus, a developing unit supporting a developing roller for developing an electrostatic latent image formed on said electrophotographic photosensitive member with a developer, wherein said developing unit is movable relative to said drum unit between a contacting position in which said developing roller is contacted to said electrophotographic photosensitive member and a spaced position in which said developing roller is spaced from said electrophotographic photosensitive member, and a space maintaining member movable between an engaging position for maintaining said developing unit in the spaced position and a releasing position for permitting said developing unit to move to the contacting position, wherein said space maintaining member is moved to the releasing position by being abutted by the main assembly positioning portion when said process cartridge is mounted to the main assembly of the apparatus; and (iii) feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. However, the structural components of the process cartridge and electrophotographic image forming apparatus in the following preferred embodiments are to be modified as necessary in shape and positional relationship according to the structure of the apparatuses to which the present invention is applied, and the various conditions under which the apparatuses are operated. That is, unless specifically noted, the following preferred embodiments are not intended to limit the present invention in scope.

Embodiment 1

(General Structure of Image Forming Apparatus)

Figure 2:
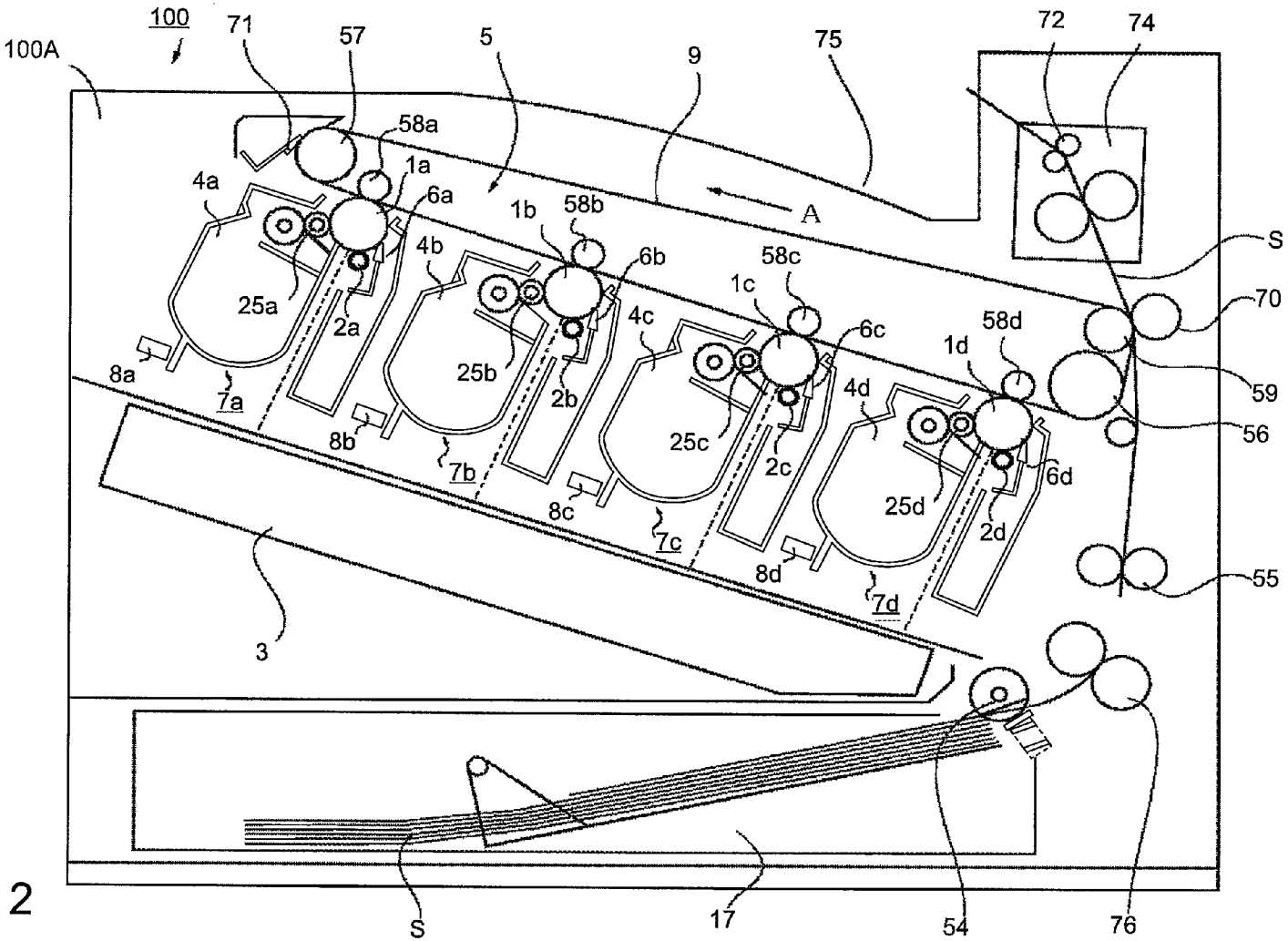
FIG. 2 is a schematic sectional view of the electrophotographic color image forming apparatus in the first embodiment, which depicts the general structure of the apparatus.

First, referring to FIG. 2, the electrophotographic image forming apparatus 100 (which hereafter will be referred simply as image forming apparatus) in this embodiment will be described regarding its general structure. The image forming apparatus uses four process cartridges 7 (7*a*, 7*b*, 7*c*, and 7*d*), which are removably mountable in the main assembly of the apparatus by being assisted by a cartridge mounting member (unshown), as shown in FIG. 2. As the four cartridges 7 are mounted into the main assembly 100A of the image forming apparatus 100, they become aligned in tandem in a direction which is inclined relative to the horizontal direction.

The process cartridges 7 are provided with electrophotographic photosensitive drums 1 (1*a*-1*d*), and processing means, more specifically, charge rollers 2 (2*a*, 2*b*, 2*c*, and 2*d*), development rollers 25 (25*a*, 25*b*, 25*c*, and 25*c*), and cleaning members 6 (6*a*, 6*b*, 6*c*, and 6*d*, respectively). The electrophotographic photosensitive drum 1 and processing means are integrally disposed so that the processing means are in the adjacencies of the peripheral surface of the electrophotographic photosensitive drum 1 (which hereafter will be referred to simply as photosensitive drum 1). The charge roller 2 is for uniformly charging the photosensitive drum 1 (1*a*-1*d*) across the peripheral surface. The development roller 25 is for developing the abovementioned electrostatic latent image on the photosensitive drum 1 with the use of developer (which hereafter may be referred to as toner). The cleaning member 6 is for removing the developer remaining on the peripheral surface of the photosensitive drum 1 after the abovementioned transfer of the toner image from the photosensitive drum 1 onto an intermediary transferring means.

As for the main assembly of the image forming apparatus, it is provided with a scanner unit 3, which forms a latent image on the photosensitive drum 1 by selectively exposing numerous points of the charged area of the peripheral surface of the photosensitive drum 1 based on the information regarding the image to be formed. The scanner unit 3 is disposed so that it will be below the process cartridge 7 after the completion of the mounting of the process cartridge into the apparatus main assembly 100A.

Mounted in the bottom portion of the apparatus main assembly 100A is a cassette 17, which contains multiple sheets of recording medium S. The apparatus main assembly 100A is also provided with a recording medium conveying means, which is structured so that the recording medium S is conveyed upward of the apparatus main assembly 100A by way of a secondary transfer roller 70 and a fixing portion 74. That is, the apparatus main assembly 100A is provided with: a recording medium conveying roller 54 which feeds the recording mediums S in the cassette 17 into the apparatus main assembly 100A while separating the top recording medium S from the rest; a pair of recording medium conveying rollers 76 which convey further each of the fed recording mediums S; and a pair of registration rollers 55 which synchronize the delivery of each recording medium S to the interface between each photosensitive drum 1 and intermediary transfer means, with the arrival of the toner image on the photosensitive drum 1 to the interface. Further, located above the process cartridges 7 (7*a*, 7*b*, 7*c*, and 7*d*) is an intermediary transferring means, more specifically, an intermediary transfer unit 5, for transferring the toner images formed on the photosensitive drums 1 (1*a*, 1*b*, 1*c*, and 1*d*). The intermediary transfer unit 5 has a transfer belt 9, a driver roller 56, a follower roller 57, multiple (four in this embodiment) primary transfer rollers 58 (58*a*, 58*b*, 58*c*, and 58*d*), and a belt backing roller 59. The transfer belt 9 is suspended by the driver roller 56, follower roller 57, and belt backing roller 59. The primary transfer rollers 58 are disposed so that they oppose the photosensitive drums 1, one for one, with the presence of the transfer belt 9 between the transfer rollers 58 and photosensitive drums 1. The belt backing roller 59 is disposed so that it opposes a transfer roller 70 with the presence of the transfer belt 9 between the two rollers 59 and 70. The transfer belt 9 is circularly driven in contact with all the photosensitive drums 1. As a preset voltage is applied to the primary transfer rollers 58 (58*a*, 58*b*, 58*c*, and 58*d*) while the transfer belt 9 is circularly driven, the toner images on the photosensitive drums 1 (1*a*, 1*b*, 1*c*, and 1*d*) are sequentially transferred (primary transfer) in layers onto the transfer belt 9. Then, the toner images on the transfer belt 9 are transferred all at once (secondary transfer) onto the recording medium S by applying a preset voltage between the belt backing roller 59 (which is inside the loop which the transfer belt 9 forms) and secondary transfer roller 70.

The image forming operation performed by this image forming apparatus is as follows: Each photosensitive drum 1 is rotated while being uniformly charged by the charge roller 2 across its peripheral surface. Then, numerous points of the uniformly charged area of the peripheral surface of the photosensitive drum 1 are selectively exposed by a scanner unit 3. As a result, an electrostatic latent image is formed on the peripheral surface of the photosensitive drum 1. Then, the electrostatic latent image is developed by the development roller 25. Thus, four monochromatic images, different in color, are formed of developer, on the four photosensitive drums 1, one for one. Meanwhile, the pair of registration rollers 55 convey the recording medium S to the secondary transfer portion, that is, where the belt backing roller 59 and secondary transfer roller 70 are kept pressed against each other with the presence of the transfer belt 9 between the two rollers 59 and 70, in synchronism with the progression of the above described image forming operation. Then, while the recording medium S is conveyed through the secondary transfer portion, a preset transfer bias is applied to the secondary transfer roller 70. As a result, the developer images on the transfer belt 9 are transferred (secondary transfer) onto the recording medium S, effecting a single multicolor image on the recording medium S. After the formation of the multicolor image on the recording medium S, the multicolor image (formed of four monochromatic developer images) on the recording medium S is fixed to the recording medium S by the heat and pressure applied to the recording medium S and the multicolor image thereon by the fixing portion 74. Then, the recording medium S is discharged into a delivery portion 75 by a pair of discharge rollers 72. The fixing portion 74 is in the upper portion of the apparatus main assembly 100A. Designated by a referential number 71 is a cleaning blade for removing the toner remaining on the transfer belt 9 after the transfer of the developer images from the transfer belt 9 onto the recording medium S.

(Process Cartridge)

Figure 3:
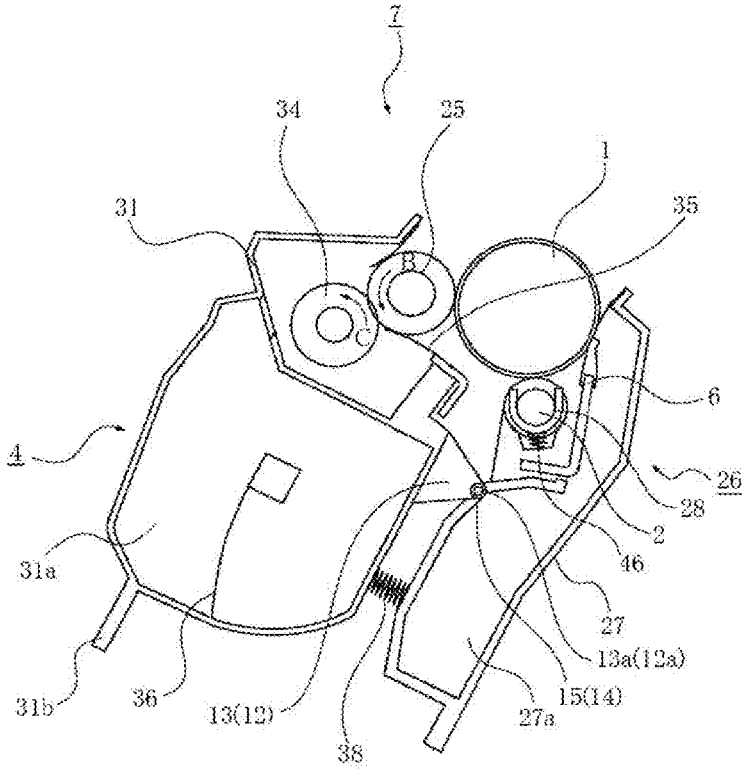
FIG. 3 is a schematic sectional view of the process cartridge in the first embodiment, which depicts the general structure of the cartridge.

Next, referring to FIGS. 3-5, the process cartridge in this embodiment will be described. FIG. 3 is a sectional view of the process cartridge 7, in which developer (which hereafter will be referred to as toner) is stored, at a plane perpendicular to the lengthwise direction of the cartridge 7. Incidentally, the process cartridges 7*a*, 7*b*, 7*c*, and 7*d*, which store yellow magenta, cyan, and black toners, respectively, are the same in structure.

The process cartridges 7 (7*a*, 7*b*, 7*c*, and 7*d*) have a latent image formation unit 26 (26*a*, 26*b*, 26*c*, or 26*d*) and a development unit 4 (4*a*, 4*b*, 4*c*, or 4*d*). The latent image formation unit 26 has the photosensitive drum 1 (1*a*, 1*b*, 1*c*, or 1*d*), charge roller 2 (2*a*, 2*b*, 2*c*, or 2*d*), and cleaning member 6 (6*a*, 6*b*, 6*c*, or 6*d*, respectively). The development unit 4 has the development roller 25 (25*a*, 25*b*, 25*c*, or 25*d*).

It is by the cleaning means frame 27 of the latent image formation unit 26 that the photosensitive drum 1 is rotatably supported. More specifically, the cleaning means frame 27 is fitted with front and rear drum bearings 10 and 11 (FIG. 4) by which the photosensitive drum 1 is rotatably supported. It should be noted here that the front and rear sides of the process cartridge 7 means the front and rear sides of the process cartridge 7 when the process cartridge is properly situated in the apparatus main assembly 100A. The rear end of the photosensitive drum 1 is fitted with a drum coupling 16, whereas the front end is fitted with flange 85.

The charge roller 2 and cleaning member 6 are disposed in the adjacencies of the peripheral surface of the photosensitive drum 1 as described above. As the toner remaining on the peripheral surface of the photosensitive drum 1 is removed by the cleaning member 6, it falls into a chamber 27*a* for the removed toner. The photosensitive drum 1 is rotated in synchronism with the progression of an image forming operation by the transmission of driving force to the latent image formation unit 26 from the motor (driving force source) with which the apparatus main assembly 100A is provided. The charge roller 2 is rotatably supported by the cleaning means frame 27 with the placement of a pair of charge roller bearings 28 between the charge roller 2 and cleaning mean frame 27. Further, the charge roller 2 is kept pressed toward the photosensitive drum 1 by a pair of charge roller pressing members 46. It is rotated by the rotation of the photosensitive drum 1.

The development unit 4 is made up of the development roller 25, and a development unit frame 31 which supports the development roller 25. The development roller 25 rotates in contact with the photosensitive drum 1 in the direction indicated by an arrow mark B. The development roller 25 is rotatably supported by the development unit frame 31 with front and rear development roller bearings 12 and 13 attached to the front and rear walls of the development unit frame 31, respectively (FIG. 5). Further, the development unit 4 is provided with a toner supply roller 34 and a development blade 35, which are disposed in the adjacencies of the peripheral surface of the development roller 25. The toner supply roller 34 rotates in contact with the development roller 25 in the direction indicated by an arrow mark C. The development blade 35 is for regulating in thickness the layer of toner on the peripheral surface of the development roller 25. Further, the development unit 4 is provided with a toner conveying member 36 for conveying the toner in the toner storage portion 31*a* of the development unit 4 to the abovementioned toner supply roller 34 while stirring the toner. The toner conveying member 36 is disposed in the toner storage portion 31*a* of the development unit frame 31.

Figure 4:
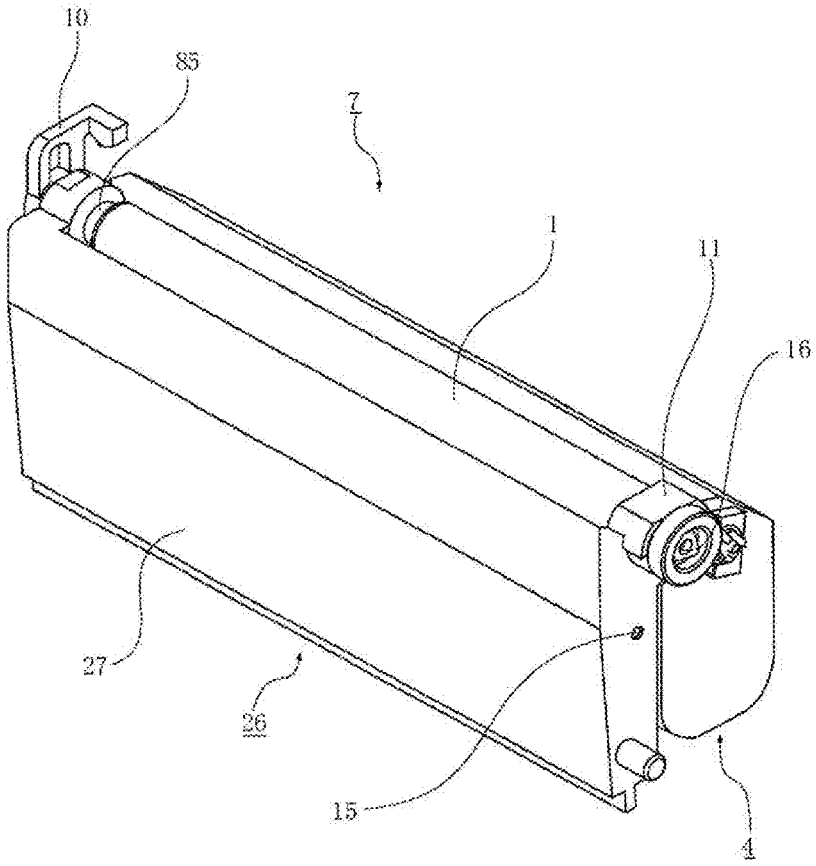
FIG. 4 is an external perspective view of the process cartridge in the first embodiment.

FIG. 4 is an external perspective view of the process cartridge 7. The development unit 4 is attached to the latent image formation unit 26 so that the former can be rotationally moved relative to the latter. More specifically, the development unit 4 is provided with front and rear bearings 12 and 13, which are provided with holes 12*a* and 13*a*, respectively, into which the front and rear shafts 14 and 15 (axles) are fitted after being pressed through the corresponding shaft (axle) holes with which the front and rear walls of the cleaning unit frame 27 are provided, respectively, whereby the development unit 4 is supported by the cleaning means frame 27 in such a manner that the development unit 4 is allowed to rotationally move about the front and rear shafts 14 and 15, respectively (FIG. 3). Further, the cleaning means frame 27 is provided with the aforementioned front and rear drum bearings 10 and 11, with which the photosensitive drum 1 is rotatably supported. More specifically, the rear drum bearing 11 supports the drum coupling 16 attached to the photosensitive drum 1, whereas the front drum bearing 10 supports the flange 85. The drum coupling 16 is the coupling for transmitting rotational driving force to the photosensitive drum 1 from the apparatus main assembly 100A.

Figure 5:
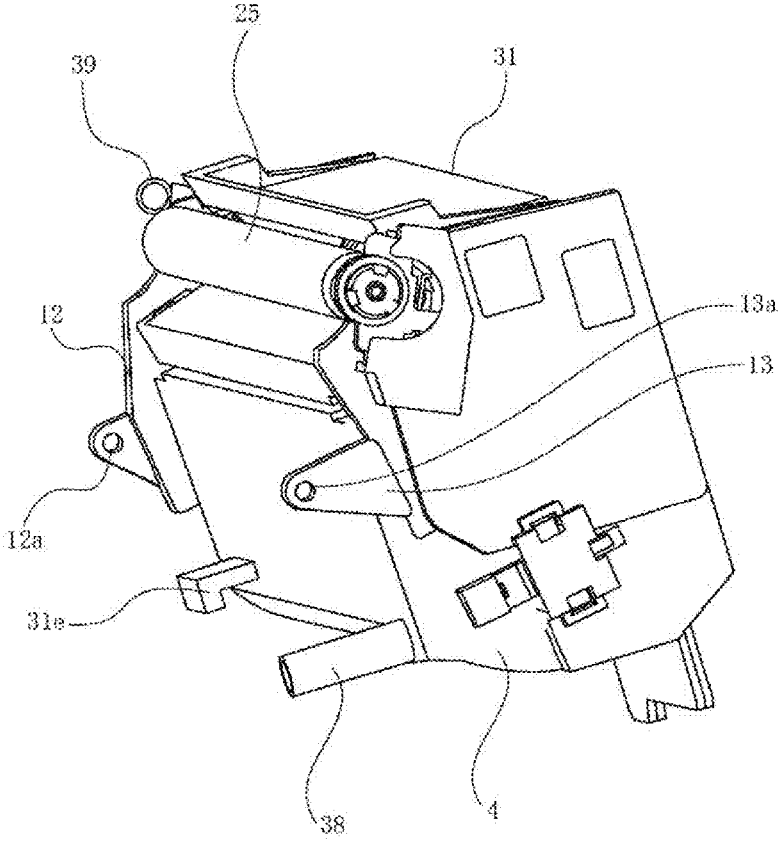
FIG. 5 is a perspective view of the development unit of the process cartridge in the first embodiment.

Referring to FIG. 5, the process cartridge 7 is structured so that while the process cartridge 7 is used for an actual image forming operation, the development roller 25 in the development unit 4 is kept pressed upon the photosensitive drum 1 in the latent image formation unit 26 by the compression spring 38 with which the development unit frame 31 is provided, and a tension spring 39 with which the front development roller bearing 12 is provided. The compression spring 38 and tension spring 39 generate the pressure that works in the direction to rotate the development unit 4 about the axes of the front and rear development roller bearings 12 and 13 so that the development roller 25 is placed, and kept, in contact with the photosensitive drum 1.

In a case where the so-called contact developing method, which places the photosensitive drum 1 and development roller 25 in contact with each other when developing a latent image on the photosensitive drum 1, it is desired that the photosensitive drum 1 is made as a rigid member, whereas the development roller 25 is provided with an elastic surface layer, for example, a layer of solid rubber. In consideration of the toner charging property of solid rubber, the solid rubber layer may be coated with resin.

Next, the sequential steps in the image forming operation of the process cartridge 7 will be described (FIGS. 2 and 3). As the information regarding an image to be formed is sent to the image forming apparatus 100, the motor (unshown) of the apparatus main assembly 100A begins to be rotated, and the rotational driving force therefrom is transmitted to the photosensitive drum 1, development roller 25, toner supply roller 34, and toner conveying member 36. Then, a charge bias voltage is applied to the charge roller 2 from the apparatus main assembly 100A, uniformly charging the peripheral surface of the photosensitive drum 1. Then, the uniformly charged portion of the peripheral surface of the photosensitive drum 1 is exposed by the scanner unit 3. As a result, a latent image is effected on the photosensitive drum 1.

Meanwhile, the toner in the toner storage portion 31*a* is conveyed to the toner supply roller 34 by the rotation of the toner conveying member 36. As the toner is conveyed to the toner supply roller 34, it is supplied to the peripheral surface of the rotating development roller 25 by the toner supply roller 34, which also is rotating. After being supplied to the peripheral surface of the development roller 25, it is frictionally charged by the development blade 35. To the development roller 25, a development bias voltage is applied from an electric power source (unshown) with which the apparatus main assembly 100A is provided. As a result, the electrostatic latent image on the photosensitive drum 1 is developed. Incidentally, the development roller 25 is disposed so that the peripheral surface of the development roller 25 faces the peripheral surface of the photosensitive drum 1; the image forming apparatus 100 is structured so that the development roller 25 contacts the photosensitive drum 1 to develop the electrostatic latent image formed on the photosensitive drum 1.

(Structural Arrangement for Mounting Process Cartridge into Apparatus Main Assembly)

Next, referring to FIGS. 6 and 7, the structural arrangement of the apparatus main assembly 100A, which is for allowing the process cartridge 7 to be removably mounted in the apparatus main assembly 100A, will be described.

Figure 6:
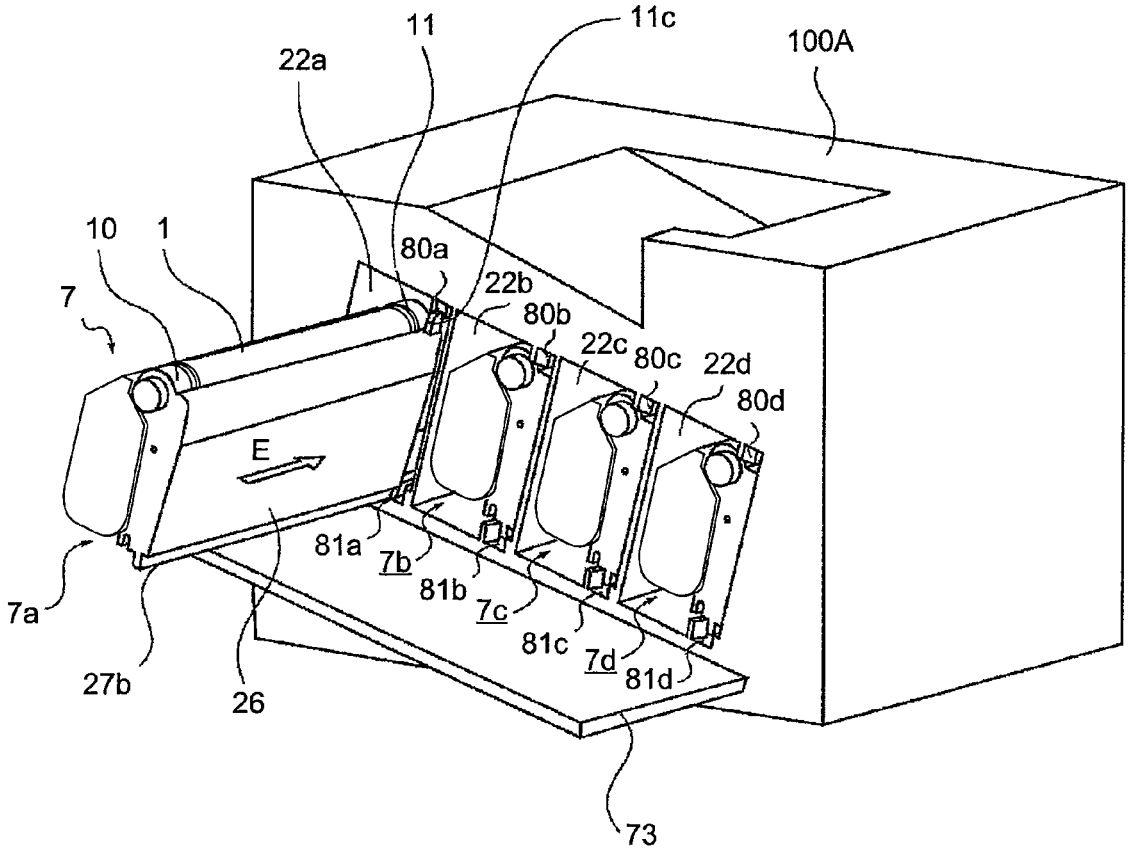
FIG. 6 is a perspective view of the image forming apparatus in the first embodiment.

FIG. 6 is a perspective view of the image forming apparatus prior to the mounting of the process cartridge 7*a* into the main assembly 100A of the image forming apparatus 100. Incidentally, the image forming apparatus 100 in this embodiment is structured so that the process cartridge 7 is to be mounted into the apparatus main assembly 100A in the direction indicated by an arrow mark E, which is parallel to the axial line of the photosensitive drum 1, that is, from the front side (reader's side) of the page on which FIG. 2 is on, to the rear side (opposite side from reader's side). Regarding the definition of the front and rear of the process cartridge 7 in this embodiment, the upstream side of the process cartridge 7 in terms of the direction in which the process cartridge 7 is mounted into the apparatus main assembly 100A is referred to as the front, and the downstream side is referred to as the rear.

Referring to FIG. 6, the apparatus main assembly 100A is provided with a front cover 73, which can be opened frontward. As the front cover 73 is opened, four chambers 22 (22*a*-22*d*) for the four process cartridges 7 (7*a*-7*d*), respectively, are exposed. The four process cartridge chambers 22 are arranged in tandem at a preset angle relative to the horizontal direction. There are top (first) and bottom (second) guides 80 (80*a*-80*d*) and 81 (81*a*-81*d*), which are on the top and bottom sides, respectively, of the process cartridge chambers 22. The top and bottom guides 80 and 81 extend in the direction perpendicular to the front and rear walls of the apparatus main assembly 100A. As for the proper method for mounting the process cartridge 7 into the apparatus main assembly 100A, first, the cartridge guiding top portion 11*c*, with which the rear drum bearing 11 of the process cartridge 7 is provided, and the cartridge guiding bottom portion 27*b*, with which the latent image formation unit 26, are to be engaged with the top and bottom guides 80 and 81, respectively, of the apparatus main assembly 100A, and then, the process cartridge 7 is to be pushed into the apparatus main assembly 100A in the direction indicated by an arrow mark E in the drawing.

Incidentally, the abovementioned guiding portion 11*c* is a part of the top rear end of the process cartridge 7, whereas the bottom guiding portion 27*b* is a part of the bottom wall of the process cartridge 7. The bottom guiding portion 27*b* is on the outward side of the bottom wall of the process cartridge 7, and extends in the direction parallel to the lengthwise direction of the process cartridge 7.

Next, referring to FIG. 7, the mounting of the process cartridge 7 will be described regarding the direction parallel to the lengthwise direction of the cartridge 7.

Figure 7:
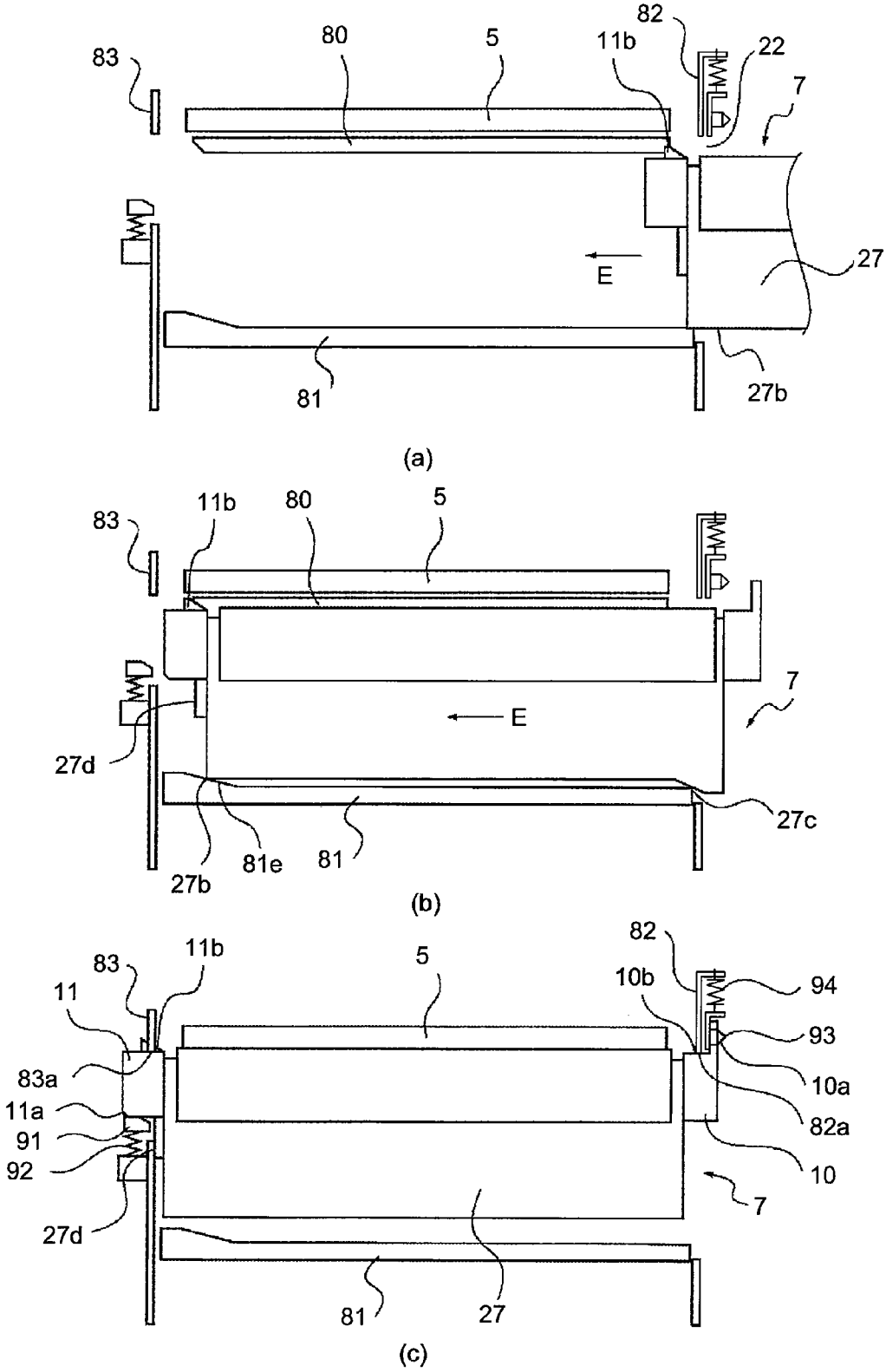
FIGS. 7(*a*)-7(*c*) are schematic drawings for depicting the steps in the operation for mounting the process cartridge into the main assembly of the image forming apparatus, in the first embodiment.

FIG. 7(*a*) is a schematic drawing of a combination of one of the process cartridge chamber of the apparatus main assembly 100A and the corresponding process cartridge 7 positioned ready to be mounted into the process cartridge chamber. The process cartridge 7 is mounted into one of the process cartridge chambers 2 of the apparatus main assembly 100A in the direction indicated by the arrow mark E in FIG. 7(*a*), in such a manner that the top guiding portion 11*b*, with which the rear drum bearing of the process cartridge 7 is provided, fits into the top guide 80, with which the apparatus main assembly 100A is provided, and also, that the bottom guiding portion 27*b*, which is the integral part of the cleaning means frame 31, fits in the bottom guide 81, with which the apparatus main assembly 100A is provided. The top and bottom guides 80 and 81 are the guides for precisely guiding the process cartridge 7 when the process cartridge 7 is removably mounted into the apparatus main assembly 100A (process cartridge chamber 22).

FIG. 7(*b*) is a schematic drawing of the combination of one of the process cartridge chambers 22 of the apparatus main assembly 100A, and the process cartridge 7 having been almost completely mounted into the apparatus main assembly 100A. The top surface of the bottom guide 81 of the apparatus main assembly 100A is provided with an upwardly inclined portion 81*e* (with reference to cartridge insertion direction), which is near the downstream end of the bottom guide 81, whereas the cleaning means frame 27 is provided with a downwardly inclined portion 27*c* (with reference to upstream direction in terms of cartridge insertion direction). As the process cartridge 7 is mounted deep enough into the apparatus main assembly 100A for the leading end of the process cartridge 7 to near the rearmost end of the apparatus main assembly 100A, the bottom guiding portion 27*b* of the cleaning means frame 27 rides onto the inclined portion 81*e*, and the inclined portion 27*c* of the cleaning means frame 27 rides onto the bottom guide 81, whereby the process cartridge 7 is moved toward (upward) the intermediary transfer unit 5.

FIG. 7(*c*) is a schematic drawing of the combination of one of the process cartridge chambers 22 of the apparatus main assembly 100A, and the process cartridge 7 having just been completely mounted into the apparatus main assembly 100A. As the mounting of the process cartridge 7 is continued while the process cartridge 7 is moved toward the intermediary transfer unit 5, the bumper portion 27*d*, which is an integral part of the cleaning means frame 27 comes into contact with the rear wall 83 of the apparatus main assembly 100A, ending thereby the mounting of the process cartridge 7 into the apparatus main assembly 100A.

As the process cartridge 7 is moved into the position shown in FIG. 7(*c*), the pressure taking portion 11*a* of the rear drum bearing 11 comes into contact with a cartridge catching rear member 91, with which the rear wall 83 of the apparatus main assembly 100A is provided, whereby the rear drum bearing 11 is pushed up by a compression spring 92. Also as the process cartridge 7 is moved into the position shown in FIG. 7(*c*), the cartridge positioning portion 11*b*, with which the top portion of the rear drum bearing 11 is provided, comes into contact with the cartridge catching portion 83*a* of the rear wall 83 of the apparatus main assembly 100A, which also functions as a cartridge positioning portion. As a result, the leading end portion of the process cartridge 7 becomes precisely positioned relative to the apparatus main assembly 100A.

Also as the process cartridge 7 is moved into the position shown in FIG. 7(*c*), the catch portion 10*a* of the front drum bearing 10 engages with a pulling member 93, with which the front wall 82 of the apparatus main assembly 100A is provided. Since the drum pulling member 93 is attached to a tension spring 94, with which the front wall 82 is provided, the catch portion 10*a* is moved upward, causing therefore the bumper portion 10*b* of the front drum bearing 10, which doubles as the cartridge positioning member, to come into contact with the drum positioning portion 82*a* of the front wall 82 of the apparatus main assembly 100A. As a result, the front side of the process cartridge 7 is precisely positioned relative to the apparatus main assembly 100A.

Figure 8:
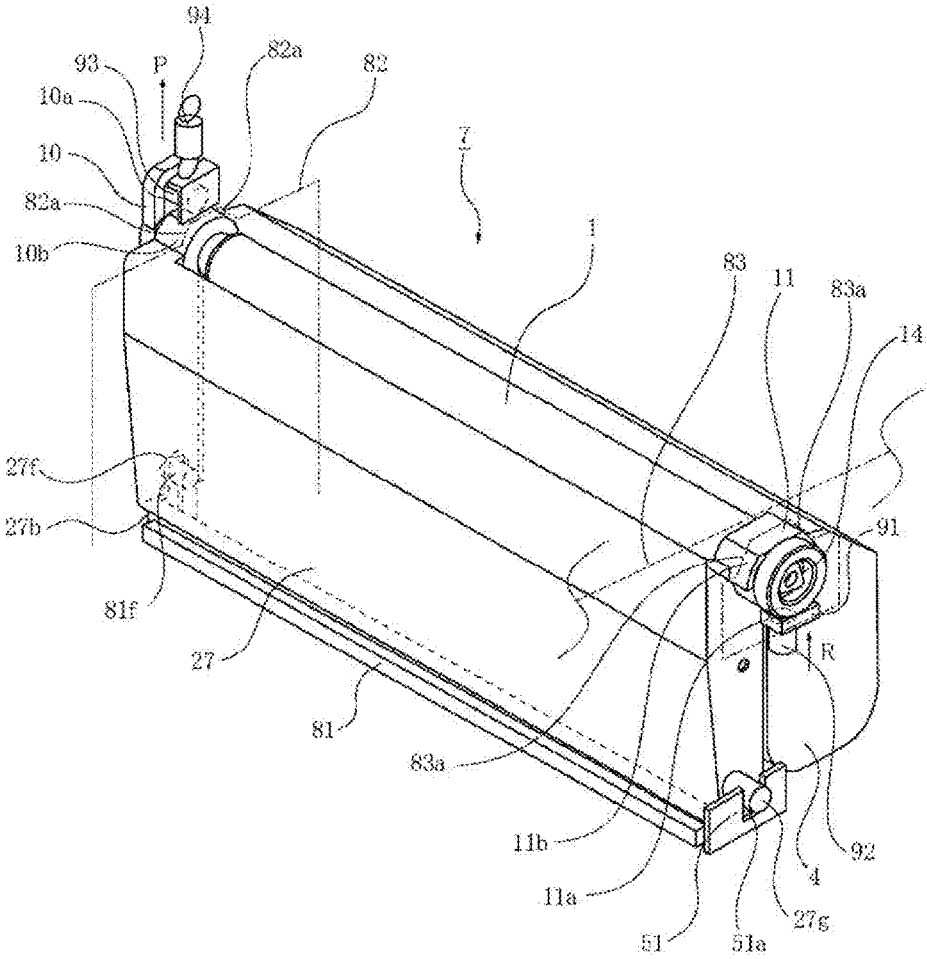
FIG. 8 is a perspective view of the process cartridge, which has just been precisely positioned in the main assembly of the image forming apparatus, and the process cartridge positioning portion of the main assembly of the image forming apparatus, in the first embodiment.

Next, referring to FIG. 8, the cartridge positioning (catching) portion 83*a* of the rear wall 83 of the apparatus main assembly 100A is roughly V-shaped in cross section. The apparatus main assembly 100A and process cartridge 7 are structured so that the cartridge positioning surface 11*b* of the rear drum bearing 11 comes into contact with the cartridge positioning portion 83*a*, and also, so that the drum pulling member 93 of the front wall 82 pulls the front drum bearing 10 in the direction indicated by an arrow mark P in the drawing, by becoming engaged with the catch portion 10*a* of the front drum bearing 10. Regarding the positioning of the process cartridge 7, the apparatus main assembly 100A and process cartridge 7 are structured so that the front drum bearing 10 comes into contact with the drum positioning portion 82*a* of the front wall 82 of the apparatus main assembly 100A, which is roughly V-shaped in cross section, in the same manner as the rear drum bearing 11 comes into contact with the rear wall 83. Further, the pressures necessary to precisely position, and keeping precisely positioned, the photosensitive drum 1 (process cartridge 7) relative to the apparatus main assembly 100A are applied to the front and rear drum bearings 10 and 11 in the directions indicated by arrow marks P and R, respectively. Therefore, the front and rear drum bearings 10 and 11, which rotatably support the photosensitive drum 1, and also, are for precisely position the process cartridge 7, are accurately positioned relative to the apparatus main assembly 100A.

Also referring to FIG. 8, the process cartridge 7 is provided with a groove 27*f* and a boss 27*g*, which also are the cartridge positioning portion, in addition to the front and rear drum bearings 10 and 11. They are integral parts of the cleaning means frame 27. Correspondingly, the apparatus main assembly 100A is provided with a front boss 81*f* and a rear groove 51*a*, which are the corresponding cartridge positioning portions of the apparatus main assembly 100A. Thus, as the process cartridge 7 is mounted into the apparatus main assembly 100A, the boss 27*g* of the process cartridge 7 fits into the groove 51*a* of the rear guide 51 of the apparatus main assembly 100A, and the front boss 81*f* of the apparatus main assembly 100A fits in the groove 27*f* of the process cartridge 7. Therefore, the process cartridge 7 remains accurately positioned relative to the apparatus main assembly 100A.

The cartridge positioning boss 27*g*, and the cartridge positioning groove 51*a* of the rear guide 51, are sized so that when the boss 27*g* is in the groove 51*a*, there is a gap of several tens of micrometers between the boss 27*g* and the wall of the groove 51*a*. Further, the groove 27*f* and front boss 81*f* are sized so that when the front boss 81*f* is in the groove 27*f*, there is a 0.1-0.2 mm gap between the front boss 81*f* and the wall of the groove 27*f*.

This structural arrangement is provided in anticipation of the possibility that as the separating member catching portion 31*b* of the developing means frame 31 is subjected to the force resulting from the operation of the development roller separating member 8 (which hereafter will be referred to simply as separating member 8) of the apparatus main assembly 100A, the combination of the rear boss 27*g* and rear boss guide 51, is insufficient for keeping the process cartridge 7 precisely positioned. In other words, the front groove 27*f* and front boss 81*f* are provided to eliminate, by the engagement between the front groove 27*f* and front boss 81*f*, the problem that when the process cartridge 7 is subjected to the force attributable to the separating member 8, the cleaning means frame 27 is rotated by the force about the axial lines of the front and rear bearings 10 and 11.

Thus, the rear boss 27*g* and rear boss guide 51, which are at the leading end of the cartridge 7, are sized so that the gap between them is very small, whereas the front groove 27*f* and front boss 81*f*, which are at the trailing end of the cartridge 7, are sized so that the gap between them is relatively large.

(Mechanism for Keeping Photosensitive Drum and Development Roller Separated from Each Other)

Next, referring to FIGS. 9 and 10, the mechanism for separating, and keeping separated, the photosensitive drum 1 and development roller 25 in the process cartridge 7 in accordance with the present invention from each other will be described.

Figure 9:
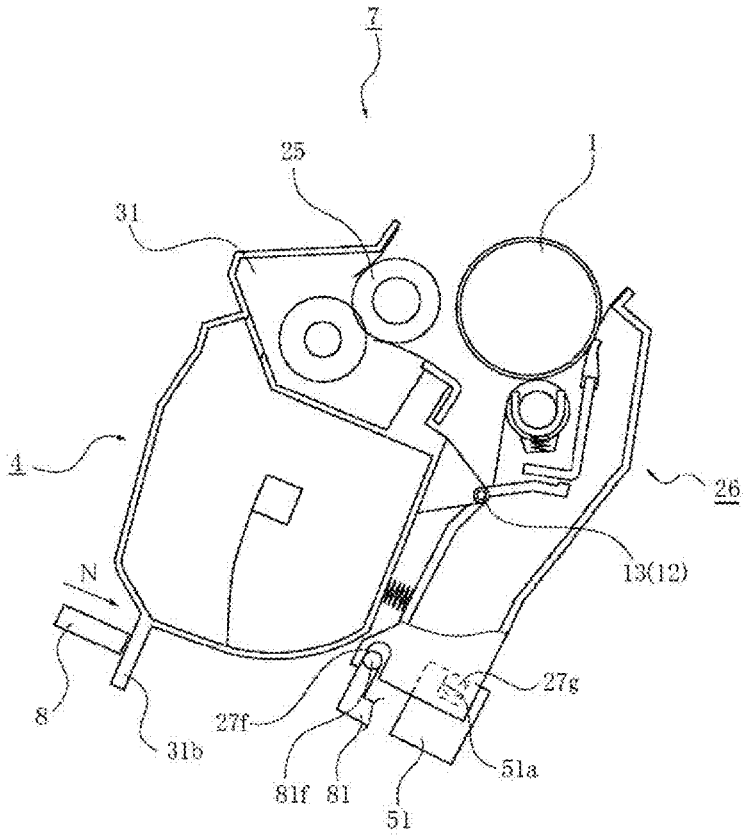
FIG. 9 is a sectional view of the process cartridge in the first embodiment, which is for depicting the operational step for separating the development roller from the photosensitive drum.

Referring to FIG. 9, the image forming apparatus 100 (unshown) is provided with the separating member 8 (8*a*, 8*b*, 8*c*, and 8*d* in FIG. 2), which corresponds in position to a predetermined position of the process cartridge 7 in terms of the lengthwise direction of the process cartridge 7. As the separating member catching portion 31*b* of the development unit frame 31 is pushed by the separating member 8 in the direction indicated by an arrow mark N, the development unit 4 of the process cartridge 7 is rotationally moved into the position in which it keeps the development roller 25 separated from the photosensitive drum 1. Before the process cartridge 7 is moved into this position in the apparatus main assembly 100A, the process cartridge 7 is kept precisely positioned relative to the apparatus main assembly 100A by the front and rear drum bearings 10 and 11, and the cartridge positioning boss 27*g* of the cleaning means frame 27 (FIG. 8). As the process cartridge 7 is subjected to the force from the separating member 8, it inclines to move in the direction indicated by the arrow mark N. If the process cartridge 7 were kept positioned by only three points (portions), that is, the front and rear drum bearings 10 and 11 and the rear positioning boss 27 (FIG. 8), it is possible that the process cartridge 7 will be deformed. This is why the apparatus main assembly 100A and process cartridge 7 are structured so that as the development unit 4 is rotationally moved to keep the development roller 25 separated from the photosensitive drum 1, the front boss 81*f* comes into contact with the wall of the front groove 27*f* to prevent the process cartridge 7 from being deformed.

Figure 10:
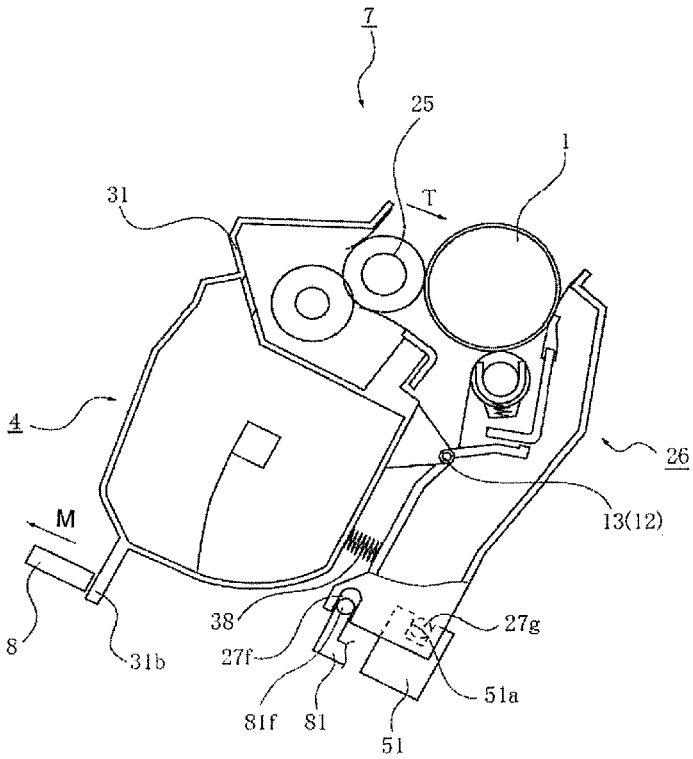
FIG. 10 is a sectional view of the process cartridge in the first embodiment cartridge, which is for depicting the operational step for allowing the development roller to be placed in contact with the photosensitive drum.

Next, referring to FIG. 10, as an image forming operation is started, the separating member 8 separates from the separating member catching portion 31*b* by being moved in the direction indicated by an arrow mark M. Thus, the development unit 4 is rotated in the direction indicated by an arrow mark T about the axial lines of the holes 12*a* and 13*a* of the front and rear development roller bearings 12 and 13 by the resiliency of the compression springs 38 and tension spring (unshown). As a result, the development unit 4 is moved into the position in which its development roller 25 remains in contact with the photosensitive drum 1. It is by the front and rear drum bearings 10 and 11, and the front positioning boss 27*g* (FIG. 8) that the process cartridge 7 is supported (kept precisely positioned) during an image forming operation.

In other words, unless the process cartridge 7 is being used for an actual image forming operation, the development unit 4 is kept in the position, shown in FIG. 9, in which its development roller 25 is kept separated from the photosensitive drum 1, by the above described mechanism for keeping the development roller 25 separated from the photosensitive drum 1. That is, the mechanism prevents the image forming apparatus 100 from being affected in image quality by the deformation of the development roller 4.

(Member for Separating, and Keeping Separated, Development Roller from Photosensitive Drum)

Figure 12:
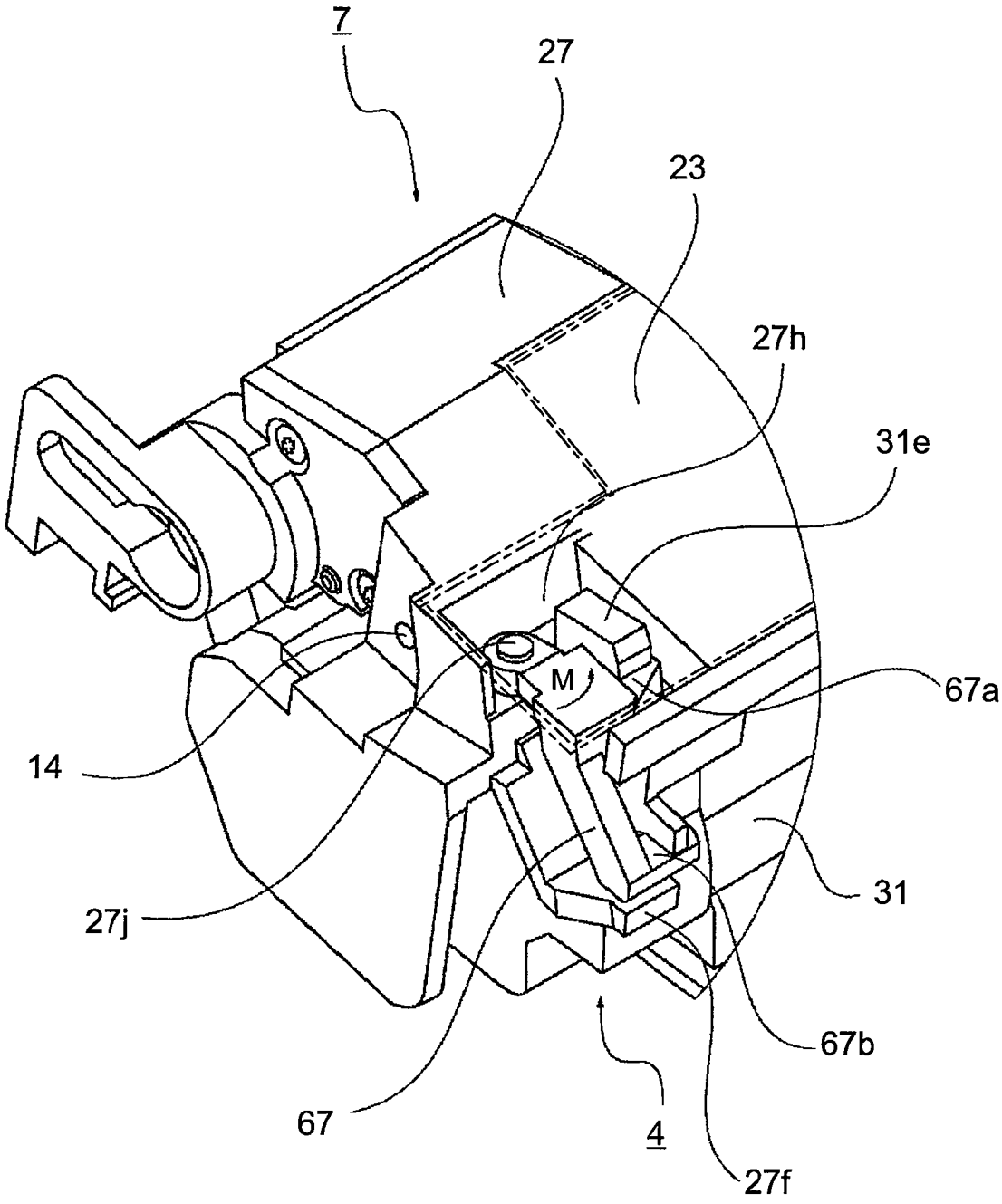
FIG. 12 is a perspective view of the user side portion of the process cartridge in the first embodiment after the member, with which the user side end portion of the process cartridge is provided to keep the development roller separated, is moved.

FIG. 12 depicts the lengthwise front end portion of the brand-new process cartridge 7 (before process cartridge 7 is mounted into apparatus main assembly 100A).

The front end portion of the cleaning means frame 27 is provided with a development roller separating front member 67 for separating the development roller 25 from the photosensitive drum 1 and keeping them separated while the process cartridge 7 is not in the apparatus main assembly 100A. The development roller separating front member 67 (which hereafter will be referred to simply as front separating member 67) is rotatably attached to a boss 27*j*, with which the cleaning unit frame 27 is provided. Further, it is kept covered with a cleaning means frame cover 23 (outlined by double-dot chain line), being thereby prevented from becoming disengaged from the boss 27*j*.

The developing unit frame 31 (FIG. 5) is provided with a retaining portion 31*e* for keeping the development roller 25 separated from the photosensitive drum 1, and the cleaning means frame 27 is provided with a hole 27*h* for allowing the retaining portion 31*e* to be put through the cleaning means frame 27. Further, the front separating member 67 is provided with a catch 67*a*, which engages with the retaining portion 31*e*.

Figure 1:
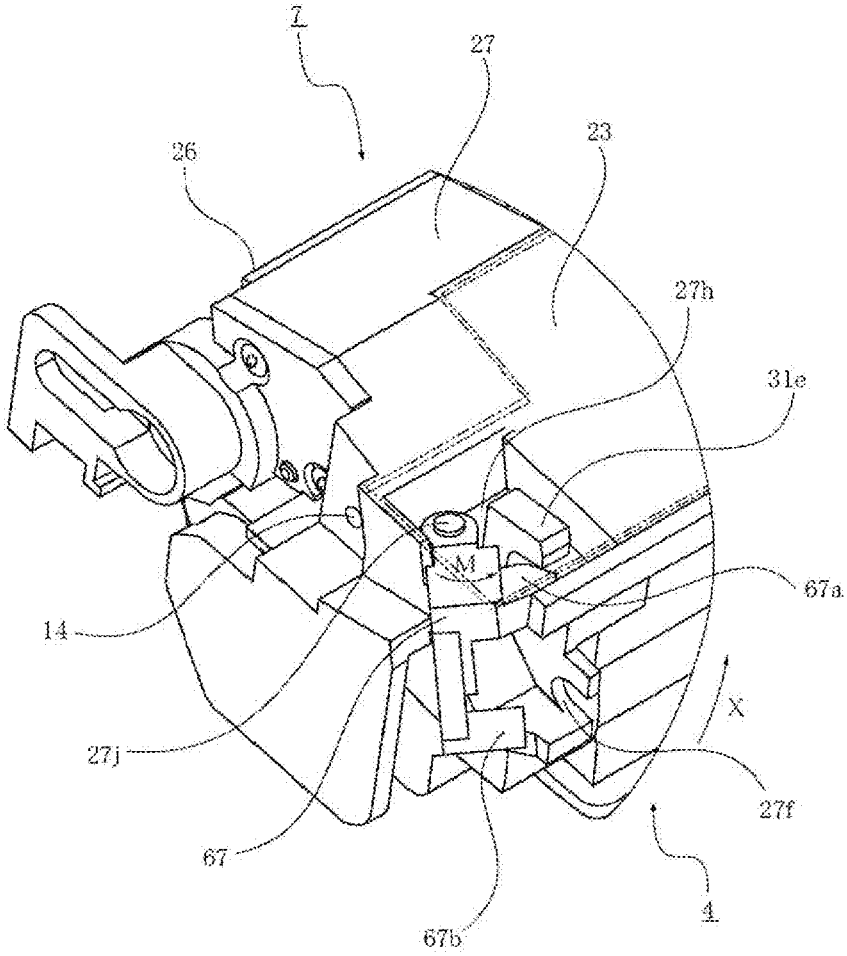
FIG. 1 is a perspective view of the lengthwise end portion of the process cartridge in the first preferred embodiment of the present invention, as seen from the front side of the image forming apparatus, before the separative member which has kept development roller separated from the photosensitive drum is moved during the mounting of the cartridge into the main assembly of the image forming apparatus.

Next, the method for engaging the catch 67*a* of the front separating member 67 with the retaining portion 31*e* will be described. FIG. 1 is a perspective view of the front end portion of the process cartridge 7 before the engagement of the front separating member 67 with the retaining portion 31*e*, and FIG. 11 is a schematic drawing for depicting how the front separating member 67 is engaged with the retaining portion 31*e*.

Figure 11:
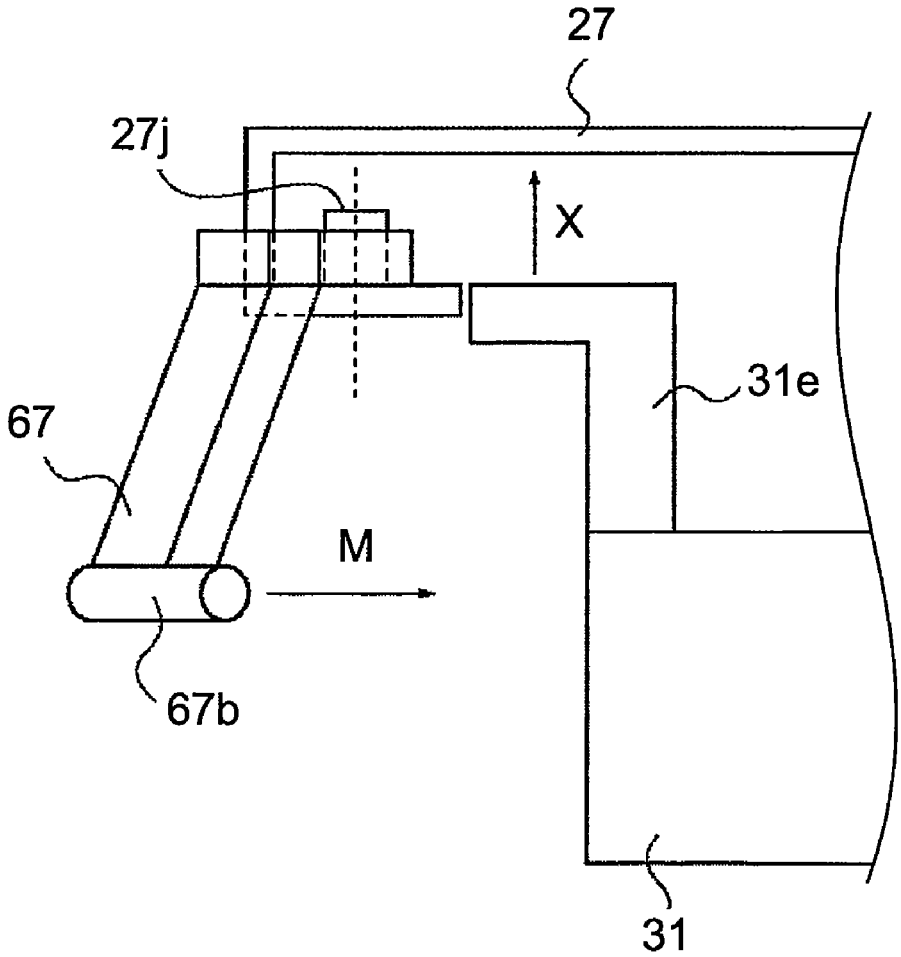
FIG. 11 is a schematic drawing of the user side portion of the process cartridge in the first embodiment before the member, with which the user side end portion of the process cartridge is provided to keep the development roller separated, is moved.

Referring to FIGS. 1 and 11, the front separating member 67 is attached to the cleaning means frame 27 so that it can be rotated about the aforementioned boss 27*j* in the direction indicated by an arrow mark M. Thus, as the development unit 4 is rotated about the front shaft 14 (and rear shaft 15) in the direction indicated by an arrow mark X as shown in FIG. 1, the retaining portion 31*e* of the developing means frame 31 also moves in the direction indicated by the arrow mark X. Then, the development unit 4 is rotated in the direction indicated by the arrow mark X, that is, the direction for separating the development roller 25 from the photosensitive drum 1, and then, the front separating member 67 shown in FIG. 1 is rotated in the direction indicated by the arrow mark M, causing thereby the catch 67*a* of the front separating member 67 to come into contact with the retaining portion 31*e* having just been inserted through the hole 27*h*. Hereafter, this position of the front separating member 67, in which the front separating member 67 remains held by the retaining portion 31*e* will be referred to as the engagement position. Further, the front separating member 67 is provided with a protrusion 67*b*, which is a portion to be fit into the positioning groove 27*f*, with which the cleaning means frame 27 is provided. As for the disengagement of the front separating member 67 and retaining portion 31*e* from each other, which will be described later in detail, the catch 67*a* of the front separating member 67 can be disengaged from the retaining portion 31*e* by manipulating the aforementioned protrusion 67*b*.

Figure 13:
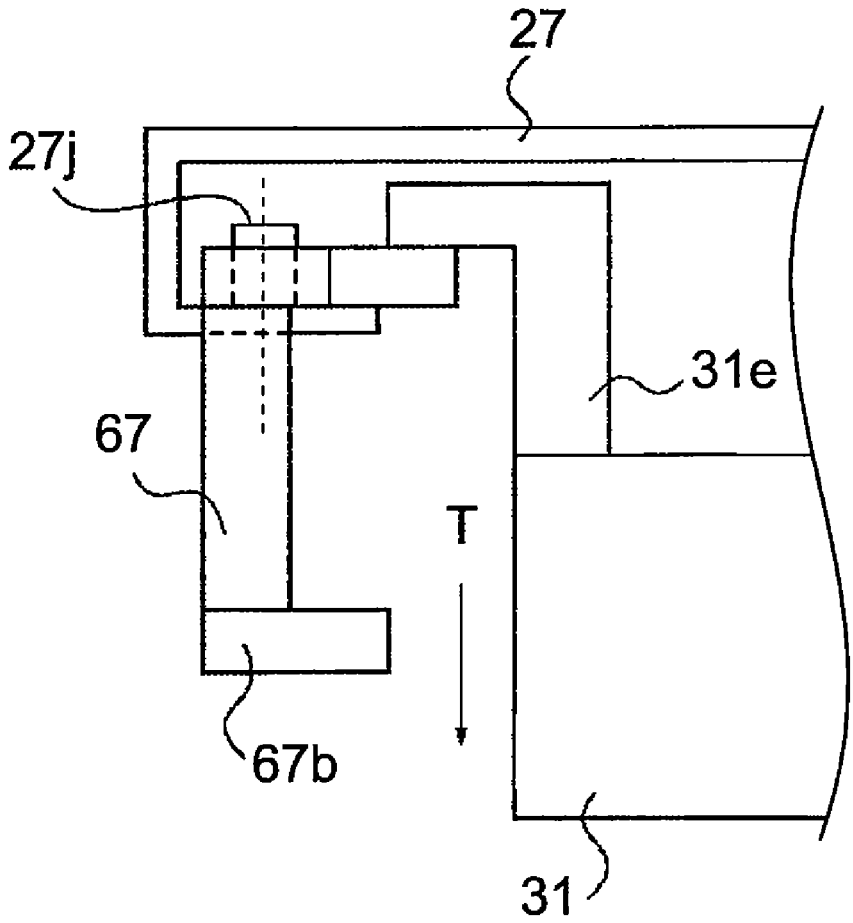
FIG. 13 is a schematic drawing of the user side portion of the process cartridge in the first embodiment after the member, with which the user side end portion of the process cartridge is provided to keep the development roller separated, is moved.

FIG. 13 is a schematic view of the front separating member 67 and retaining portion 31*e* when the two are in engagement with each other (in position of engagement). As described previously, the rotational movement of the development unit 4 about the front shaft 14 (FIG. 12) in the direction indicated by the arrow mark T (FIG. 14) is prevented by the contact between the catch portion 67*a* of the front separating member 67 and the retaining portion 31*e*. That is, the contact prevents the resiliency of the compression spring 38 (FIG. 3) and tension spring 39 (FIG. 5) from placing the development roller 25 in contact with the photosensitive drum 1.

Figure 14:
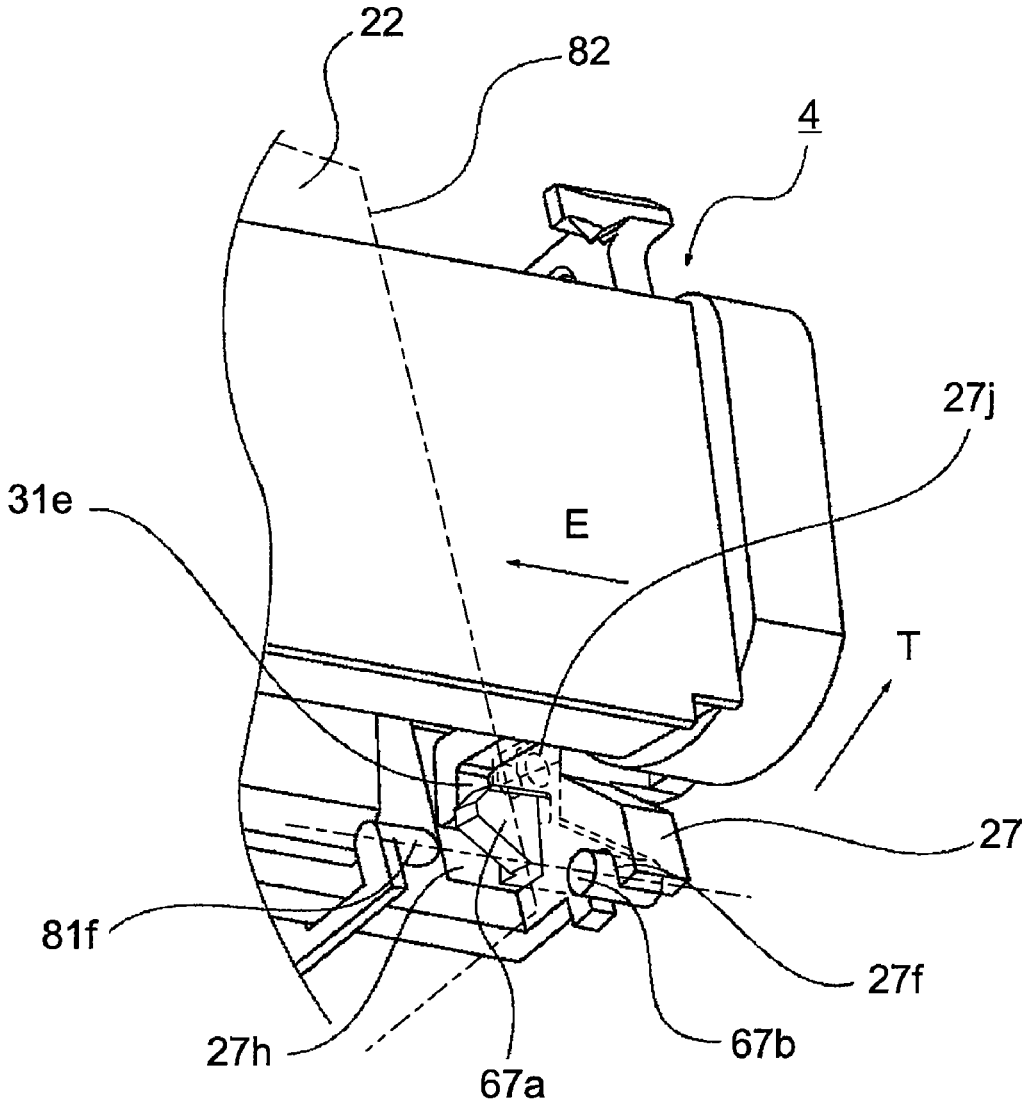
FIG. 14 is a perspective view of the user side portion of the process cartridge, and the corresponding portions of the main assembly of the image forming apparatus, immediately before the completion of the mounting of the process cartridge into the main assembly.

Next, referring to FIGS. 14 and 15, the method for disengaging the front separating member 67 will be described. FIG. 14 is a partially broken view of the front end portion of the process cartridge 7 and the front end portion of the apparatus main assembly 100A when the process cartridge 7 is being mounted into the apparatus main assembly 100A. When the process cartridge 7 is in the position depicted in FIG. 14, the engagement between the retaining portion 31*e* of the developing means frame 31 and the front separating member 67 prevents the developing means frame 31 from rotating in the direction indicated by the arrow mark T about the front shaft 14 (FIG. 12).

Figure 15:
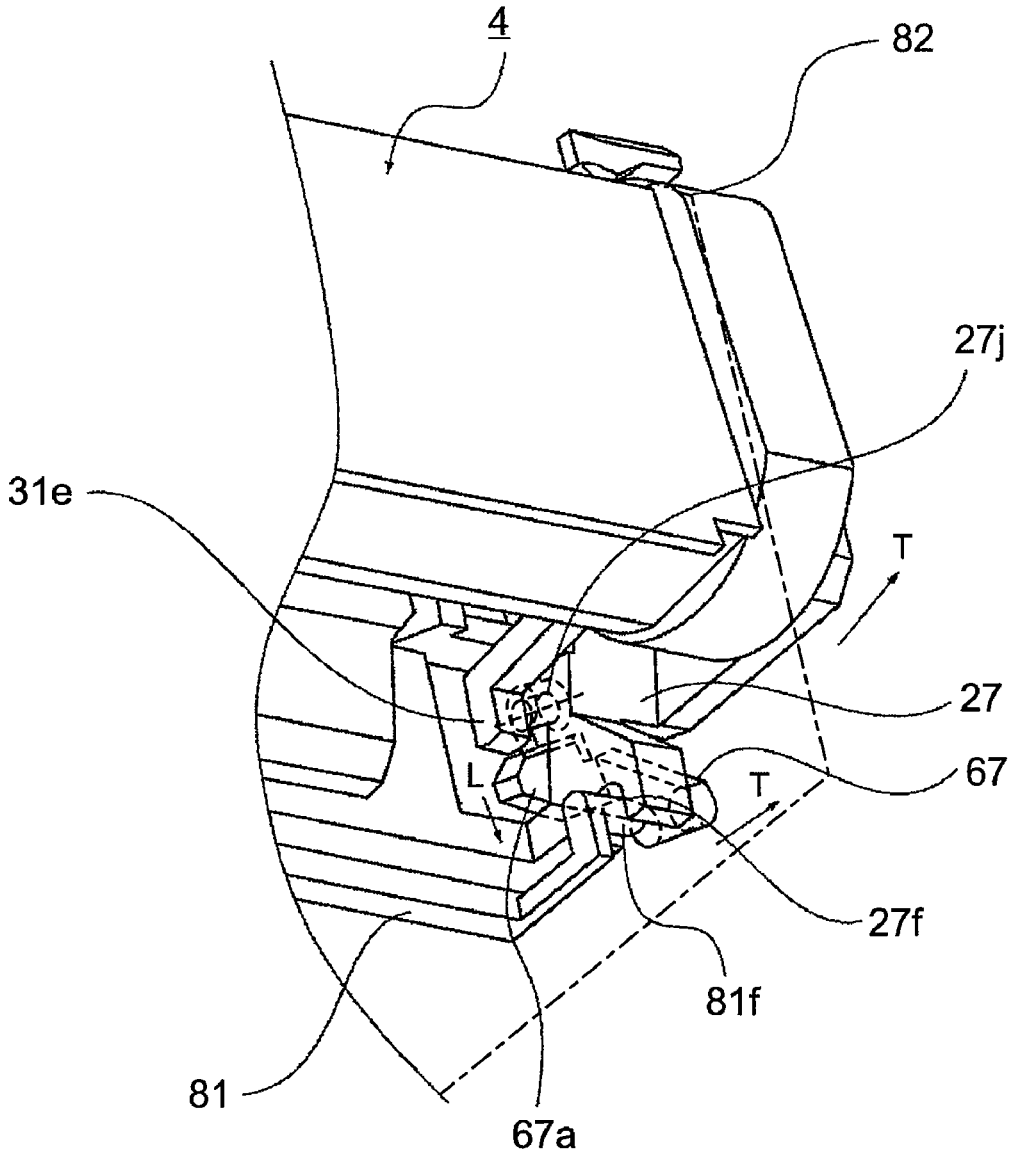
FIG. 15 is a perspective view of the user side portion of the process cartridge, and the corresponding portions of the main assembly of the image forming apparatus, immediately after the completion of the mounting of the process cartridge into the main assembly.

Referring to FIG. 15, as the process cartridge 7 is inserted further in the direction indicated by the arrow mark E, the front boss 81*f* with which the bottom guide 81 of the apparatus main assembly 100A is provided, fits into the groove 27*f*, that is, the cartridge positioning front portion of the cleaning means frame 27. Then, the front boss 81*f* comes into contact with the front separating member 67 and pushes the front separating member 67, causing the front separating member 67 to rotate about the boss 27*j*. As a result, the catch portion 67*a* of the front separating member 67, which was in engagement with the retaining portion 31*e*, is rotationally moved, disengaging from the retaining portion 31*e*. Hereafter, the position in which the front separating member 67 remains after the disengagement of its catch portion 67*a* from the retaining portion 31 will be referred to as the disengagement position.

As for the front end boss 81*f*, it remains in the cartridge positioning portion 27*f*, which is for precisely positioning the process cartridge 7 in the apparatus main assembly 100A.

Thus, as the process cartridge 7 is mounted into the apparatus main assembly 100A, the front separating member 67 which has kept development roller 25 separated from the photosensitive drum 1 is disengaged, allowing the development roller 25 to be placed in contact with the photosensitive drum 1.

Figure 16:
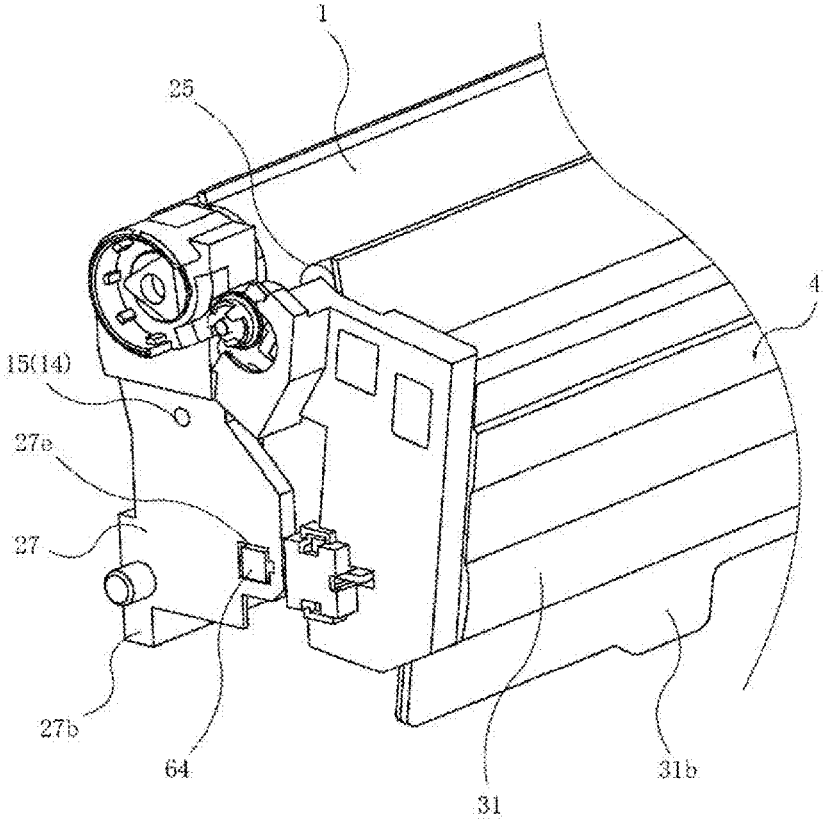
FIG. 16 is a perspective view of the opposite side portion of the process cartridge from the user, before the completion of the mounting of the process cartridge into the main assembly of the image forming apparatus.

Next, referring to FIGS. 16-18, the rear members for keeping the development roller 25 separated from the photosensitive drum 1 will be described. First, referring to FIG. 16, the development unit 4 is provided with a rear separating member 64 for keeping the development roller 25 separated from the photosensitive drum 1. The rear separating member 64 keeps the rear end portion of the development roller 25, that is, the inward end of the development roller 25 in terms of the cartridge mounting direction, separated from the photosensitive drum 1 by being engaged in the hole 27*e*, with which the rear wall of the cleaning means frame 27 is provided.

Figure 17:
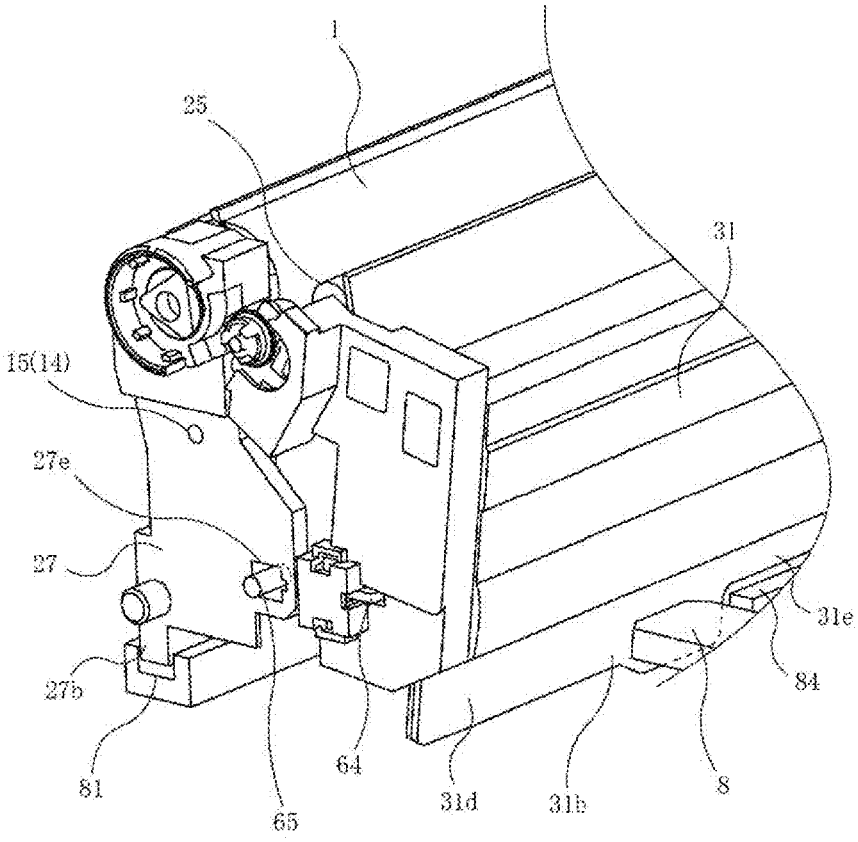
FIG. 17 is a perspective view of the opposite side portion of the process cartridge from the user side, and the corresponding portions of the main assembly of the image forming apparatus, immediately after the completion of the mounting of the process cartridge into the main assembly.

Next, referring to FIG. 17, the apparatus main assembly 100A is provided with a member 65 for disengaging the abovementioned rear separating member 64. The rear separating member disengaging member 65 is located at the rear of the apparatus main assembly 100A. As the process cartridge 7 is mounted into the apparatus main assembly 100A, the rear separating member disengaging member 65 comes into contact with the rear separating member 64, and disengages the rear separating member 64 from the hole 27*e*, immediately before the process cartridge 7 is precisely positioned relative to the apparatus main assembly 100A by the cartridge positioning portions 82*a* and 83*a* (FIG. 8) of the apparatus main assembly 100A. In other words, the apparatus main assembly 100A and process cartridge 7 are structured so that as the process cartridge 7 is mounted into the apparatus main assembly 100A, the rear separating member 64 is moved out of the hole 27*e*.

Hereafter, the position in which the rear separating member 64 remains after being moved out of the hole 27*e* will be referred to as the disengagement position. The disengagement of the rear separating member 64 allows the rear end portion of the development roller 25 to be placed in contact with the photosensitive drum 1 in the same manner as the disengagement of the front separating member 67 allows the front end portion of the development roller 25 to be placed in contact with the photosensitive drum 1.

However, the apparatus main assembly 100A is structured so that unless the image forming apparatus 100 is being used for an actual image forming operation, the separating member 8 of the apparatus main assembly 100A remains in the position (FIG. 9) in which it remains in contact with the separating member catching portion 31*b* of the developing means frame 31. Therefore, even after the disengagement of the rear separating member 64 and front separating member 67, which is caused by the mounting of the process cartridge 7 into the apparatus main assembly 100A, the development roller 25 does not come into contact with the photosensitive drum 1 unless an image forming operation is started (FIG. 9).

Next, referring to FIG. 18, the method for disengaging the rear separating member 64 will be described. FIG. 18(*a*) depicts that the rear separating member 64 is provided with a boss 64*a*. The boss 64*a* is rotatably fitted in a groove 31*c* with which the development unit frame 31 is provided. The boss 64*a* is rotatably held in the groove 31*c* by a boss pressing portion 48*b* of the side cover 48. As for the catch portion 64*b* of the rear separating member 64, it remains in the hole 27*e* of the cleaning means frame 27. Next, referring to FIG. 18(*b*), as the process cartridge 7 is moved in the direction indicated by an arrow mark E while the process cartridge 7 is in the state depicted in FIG. 7(*a*), the rear separating member disengaging member 65 enters the hole 27*e* of the cleaning means frame 27, and the rear separating member disengaging member 65 comes into contact with the rear separating member 64, causing the rear separating member 64 to rotate about the axial line of the boss 64*a*. As a result, the rear separating member 64 is disengaged from the cleaning means frame 27.

Figure 18:
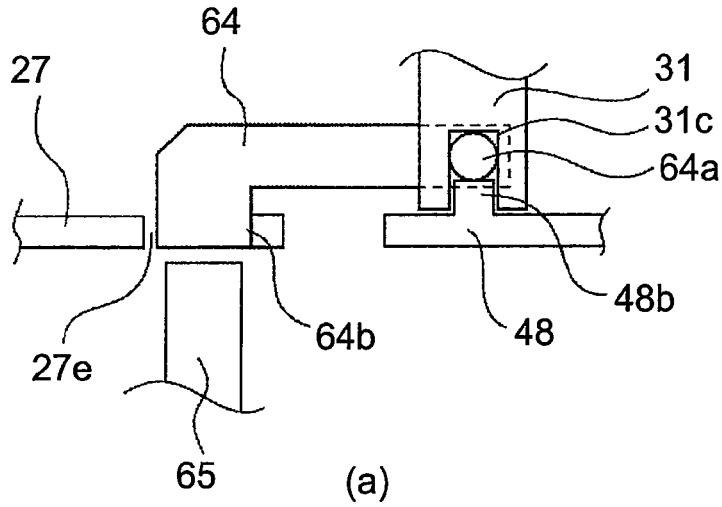
FIGS. 18(*a*)-18(*c*) are schematic drawings for depicting the mechanism of the process cartridge, which is for moving the member for keeping the development roller separated from the photosensitive drum.
Figure 18:
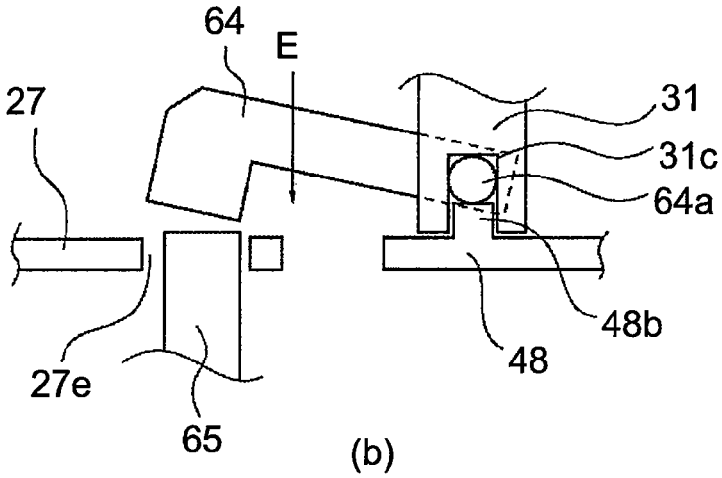
Figure 18:
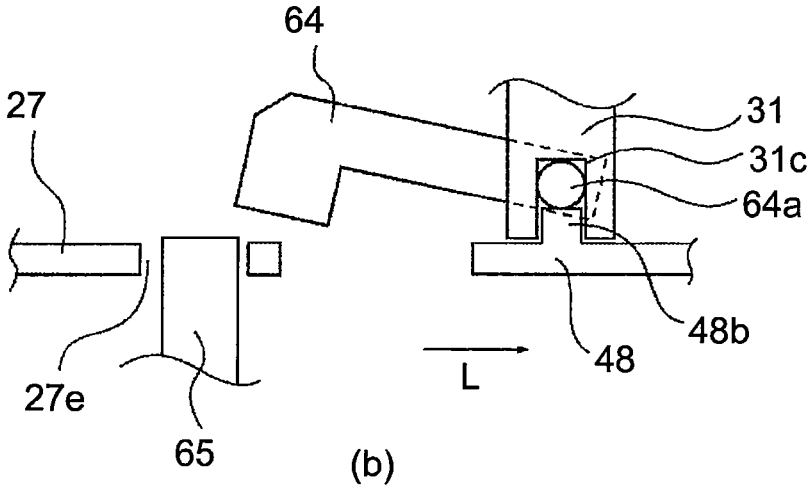

Next, referring to FIG. 18(*c*), as the rear separating member 64 is disengaged from the cleaning means from 27, the development unit frame 31 is allowed to be moved in the direction indicated by an arrow mark L so that the development roller 25 comes into contact with the photosensitive drum 1.

After the completion of the mounting of the process cartridge 7, an image forming operation is started by a print signal. As the image forming operation is started, the aforementioned separating member 8 (FIG. 8) is moved in the direction indicated by the arrow mark M, being thereby separated from the catching portion 31*b*, in synchronism with the progression of the developing operation. Thus, the development unit 4 is moved by the resiliency of the above described compression spring 38 and tension spring 39 (FIG. 5), into the contact position, in which the development roller 25 remains in contact with the photosensitive drum 1, being ready for development.

As soon as the development operation is completed, the separating member 8 is moved again in the direction indicated by the arrow mark N to apply force to the separating member catching portion 31*b*. As a result, the development unit 4 is moved into the separative position, in which it keeps the development roller 25 separated from the photosensitive drum 1. Unless the image forming apparatus is actually forming an image, the development unit 4 is kept in this separative position.

As described above, the image forming apparatus 100 and process cartridge 7 are structured so that the development unit 4 can be selectively and easily moved between the position in which it keeps the development roller 25 separated from the photosensitive drum 1, and the position in which it keeps the development roller 25 in contact with the photosensitive drum 1. Thus, it is unnecessary to strictly select the material for the elastic layer of the development roller 25 just for preventing the elastic layer from deforming.

Further, a process cartridge can be significantly reduced in size by utilizing the cartridge positioning portions of its latent image formation unit 26 to separate the development roller 25 from the photosensitive drum 1.

Further, simply placing a process cartridge in the main assembly of an image forming apparatus automatically places the development roller and photosensitive drum in the process cartridge in contact with each other, making it unnecessary for a user to perform the operation for placing the development roller in contact with the photosensitive drum.

Further, the precise position in the apparatus main assembly of an image forming apparatus, into which a process cartridge is to be mounted, is made the same as the position in the main assembly, into which the development unit is to be moved to allow the development roller to come into contact with the photosensitive drum. Therefore, the image forming apparatus in this embodiment is significantly smaller in size than a conventional one. That is, this embodiment can significantly reduce in size an electrophotographic image forming apparatus.

Further, the development roller is allowed to come into contact with the photosensitive drum, or is separated from the photosensitive drum, by the operation for precisely positioning the process cartridge relative to the apparatus main assembly. Therefore, this embodiment ensures that the development roller is separated from the photosensitive drum.

Further, the cartridge positioning portion of the process cartridge and the cartridge positioning portion of the apparatus main assembly are structured so that even after the cartridge is precisely positioned relative to the apparatus main assembly, the development roller remains separated from the photosensitive drum unless the apparatus is actually forming an image. Thus, the process cartridge 7 is unlikely to be deformed. In other words, this embodiment can prevent the process cartridge deformation attributable to the above described cause.

Embodiment 2

In the first preferred embodiment, the catch portion of the rear separating member was different in position from the process cartridge positioning portion. However, an image forming apparatus may be structured so that the rear separating member fits into the positioning hole 27*e* of the cleaning means frame 27, as shown in FIGS. 19 and 20.

Figure 19:
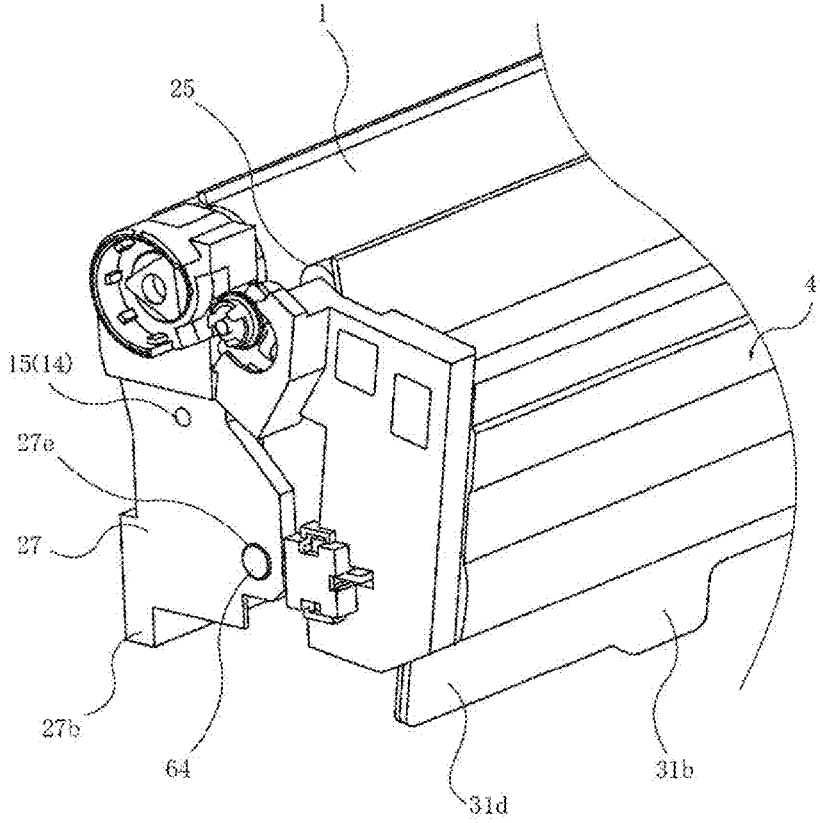
FIG. 19 is a perspective view of the opposite end portion of the process cartridge from the user side in the second preferred embodiment, before the mounting of the process cartridge into the main assembly of the image forming apparatus in the second embodiment.

More specifically, referring to FIG. 19, the development unit 4 is provided with a rear separating member 64, which is to be fitted into the positioning hole 27*e* of the rear wall of the cleaning means frame 27 to keep the rear end portion of the development roller 25 separated from the photosensitive drum 1.

Figure 20:
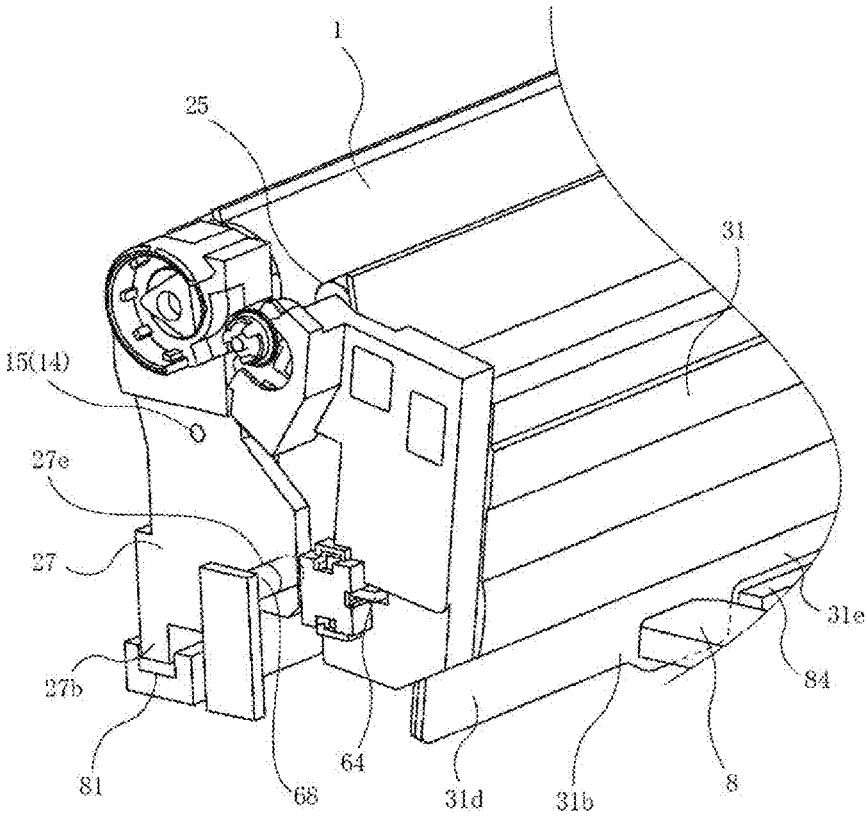
FIG. 20 is a perspective view of the opposite end portion of the process cartridge from the user side in the second preferred embodiment, immediately after the mounting of the process cartridge into the main assembly of the image forming apparatus in the second embodiment.

Next, referring to FIG. 20, the apparatus main assembly 100A is provided with a cartridge positioning rear boss 68, with which the rear separating member 64 of the process cartridge 7 comes into contact as the process cartridge 7 is mounted into the apparatus main assembly 100A. The cartridge positioning rear boss 68 is positioned so that the rear separating member 64 of the process cartridge 7 comes into contact with the cartridge positioning rear boss 68 immediately before the process cartridge 7 is precisely positioned relative to the apparatus main assembly 100A by the cartridge positioning portions 82*a* and 83*a* (FIG. 8) of the apparatus main assembly 100A during the mounting of the process cartridge 7 into the apparatus main assembly 100A. Further, the process cartridge 7 and apparatus main assembly 100A are structured so that the cartridge positioning rear boss 68 of the apparatus main assembly 100A is moved out of the cartridge positioning hole 27*e* by being pushed by the rear separating member 64 of the process cartridge 7.

Then, as the cartridge positioning front boss 81*f* of the apparatus main assembly 100A fits into the cartridge positioning hole 27*e* of the process cartridge 7, precisely positioning thereby the rear end of the process cartridge 7 relative to the apparatus main assembly 100A.

The other structural features of the apparatus main assembly 100A and process cartridge 7 in the second preferred embodiment are the same as those in the first preferred embodiment. The effects of the second embodiment are the same as those of the first embodiment.

As will be evident from the above given description of the first and second preferred embodiments of the present invention, the present invention can provide a process cartridge, which is significantly smaller in size and simpler in structure than a conventional process cartridge, and yet, the development roller of which is reliably placed in placed in contact with its photosensitive drum with no assistance from a user.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 138038/2008 filed May 27, 2008 which is hereby incorporated by reference.

What is claimed is:

1. A process cartridge detachably mountable to a main assembly of an electrophotographic image forming apparatus, said process cartridge comprising:

a drum unit supporting an electrophotographic photosensitive member;

a developing unit supporting a developing roller for developing an electrostatic latent image formed on said electrophotographic photosensitive member with a developer, wherein said developing unit is movable relative to said drum unit between a contacting position in which said developing roller is contacted to said electrophotographic photosensitive member and a spaced position in which said developing roller is spaced from said electrophotographic photosensitive member; and a process cartridge positioning portion for positioning said process cartridge relative to the main assembly of the apparatus by entering of a main assembly positioning portion provided in the main assembly of the apparatus by mounting movement of said process cartridge to the main assembly of the apparatus; and a space maintaining member capable of entering and retracting relative to said process cartridge positioning portion, said space maintaining member holding said developing unit in the spaced position in a state that said space maintaining member is in said process cartridge positioning portion, wherein said space maintaining member retracts from said process cartridge positioning portion, to permit said developing unit to move from the spaced position to the contacting position, by contacting to the main assembly positioning portion by the mounting movement of said process cartridge to the main assembly of the apparatus.

2. A process cartridge according to claim 1, wherein said process cartridge positioning portion is provided in said drum unit, and wherein said space maintaining member is provided in said drum unit and includes (a) an inserting portion capable of entering and retracting from said process cartridge positioning portion and contactable to the main assembly positioning portion, and (b) an engaging portion for engaging said developing unit to hold said developing unit in the spaced position in the state that said inserting portion is in said process cartridge positioning portion.

3. A process cartridge according to claim 1, wherein said process cartridge is mountable to the main assembly of the apparatus in a direction parallel to an axial direction of said electrophotographic photosensitive member, which is in the form of a drum.

4. A process cartridge according to claim 3, wherein said space maintaining member is provided at an upstream position with respect to a mounting direction in which said process cartridge is mounted to the main assembly of the apparatus.

5. An electrophotographic image forming apparatus for forming an image on a recording material, said apparatus comprising:

(i) a main assembly positioning portion;

(ii) a process cartridge detachably mounted to the main assembly of the electrophotographic image forming apparatus, said process cartridge including:

a drum unit supporting an electrophotographic photosensitive member;

a developing unit supporting a developing roller for developing an electrostatic latent image formed on said electrophotographic photosensitive member with a developer, wherein said developing unit is movable relative to said drum unit between a contacting position in which said developing roller is contacted to said electrophotographic photosensitive member and a spaced position in which said developing roller is spaced from said electrophotographic photosensitive member; and a process cartridge positioning portion for positioning said process cartridge relative to the main assembly of the apparatus by entering of said main assembly positioning portion provided in the main assembly of the apparatus by mounting movement of said process cartridge to the main assembly of the apparatus; and a space maintaining member capable of entering and retracting relative to said process cartridge positioning portion, said space maintaining member holding said developing unit in the spaced position in a state that said space maintaining member is in said process cartridge positioning portion; and (iii) feeding means for feeding the recording material, wherein said space maintaining member retracts from said process cartridge positioning portion, to permit said developing unit to move from the spaced position to the contacting position, by contacting to said main assembly positioning portion by the mounting movement of said process cartridge to the main assembly of the apparatus.

6. An apparatus according to claim 5, wherein said process cartridge positioning portion is provided in said drum unit, and wherein said space maintaining member is provided in said drum unit and includes (a) an inserting portion capable of entering and retracting from said process cartridge positioning portion and contactable to the main assembly positioning portion and (b) an engaging portion for engaging said developing unit to hold said developing unit in the spaced position in the state that said inserting portion is in said process cartridge positioning portion.

7. An apparatus according to claim 5, wherein said process cartridge is mountable to the main assembly of the apparatus in a direction parallel to an axial direction of said electrophotographic photosensitive member, which is in the form of a drum.

8. An apparatus according to claim 7, wherein said space maintaining member is provided at an upstream position with respect to a mounting direction in which said process cartridge is mounted to the main assembly of the apparatus.

* * * * *